United States Patent [19]

Suzuki et al.

[11] 4,420,247

[45] Dec. 13, 1983

[54] COMPUTER CONTROL MEANS FOR AN ELECTROSTATIC RECORDING APPARATUS

[75] Inventors: Koji Suzuki, Yokohama; Joji Nakahira, Tokyo; Koki Kuroda, Yokohama; Nao Nagashima, Tokyo; Yoshiaki Takayanagi, Kawasaki, all of Japan

[73] Assignee: Canon Kabushiki Kaisha, Tokyo, Japan

[21] Appl. No.: 219,513

[22] Filed: Dec. 23, 1980

[30] Foreign Application Priority Data

Dec. 28, 1979 [JP] Japan ..... 54-171351
Jan. 31, 1980 [JP] Japan ..... 55-12926
Jan. 31, 1980 [JP] Japan ..... 55-12928

[51] Int. Cl.[3] ..... G03G 15/01
[52] U.S. Cl. ..... 355/14 C; 355/14 CH
[58] Field of Search ..... 355/14 R, 14 CH, 14 C; 364/107, 200

[56] References Cited

U.S. PATENT DOCUMENTS 3,914,047 10/1975 Hunt et al. ..... 355/14 C
4,306,803 12/1981 Donohue et al. ..... 355/14 C

*Primary Examiner*—R. L. Moses
*Attorney, Agent, or Firm*—Fitzpatrick, Cella, Harper & Scinto

[57] ABSTRACT

A surface potential measuring meter and an electrostatic recording apparatus are disclosed. The surface potential measuring meter detects the surface potential on an object to be measured as AC signal. The electrostatic recording apparatus is provided with the surface potential measuring meter to measure the surface potential of an electrostatic latent image formed on a recording medium in the apparatus. The outputs from the meter are used to control various conditions for forming images with the apparatus.

11 Claims, 53 Drawing Figures

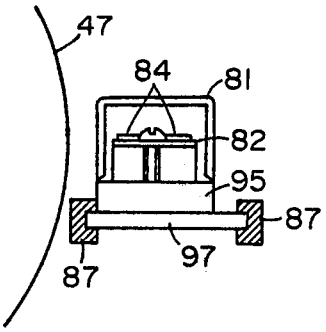
FIG. 6
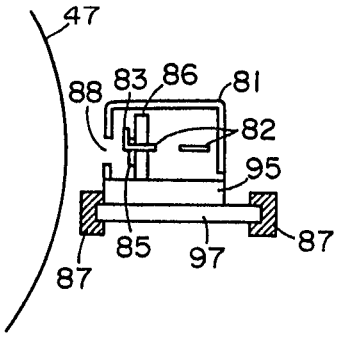
FIG. 7
FIG. 8A
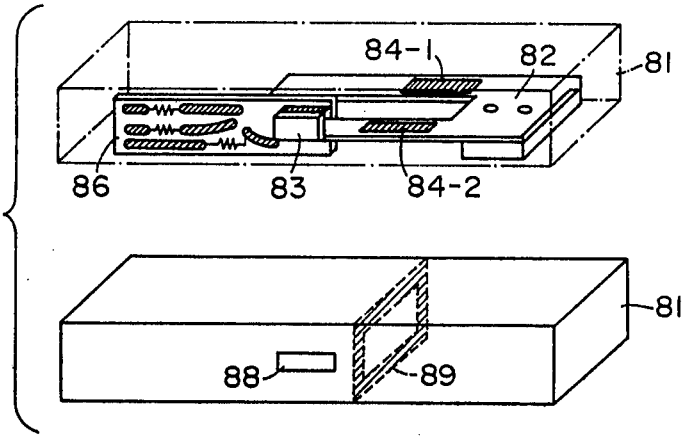
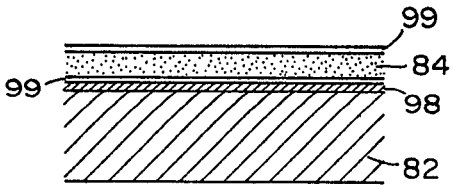
FIG. 8B

| | |
|---|---|
| FIG. 16A | FIG. 16B |
| FIG. 16C | FIG. 16D |

FIG. 16

| | | | |
|---|---|---|---|
| FIG. 17A | FIG. 17B | FIG. 17C | FIG. 17D |
| FIG. 17E | FIG. 17F | FIG. 17G | FIG. 17H |

FIG. 17

COMPUTER CONTROL MEANS FOR AN ELECTROSTATIC RECORDING APPARATUS

BACKGROUND OF THE INVENTION

1. Field of the Invention

The present invention relates to an electrometer for measuring surface potential of an object to be measured. The surface potential measuring meter detects the surface potential as an AC signal. The present invention relates also to an electrostatic recording apparatus of the type in which an electrostatic latent image is formed on a recording medium and then the latent image is visualized. The recording apparatus is provided with the surface potential measuring meter to measure the surface potential of the formed latent image. Also, the present invention relates to such electrostatic recording apparatus in which the surface potential of latent image is measured and various conditions for image formation are controlled by means of the measured output.

2. Description of the Prior Art

To detect the surface potential of an object to be measured as AC signal, there has been used hitherto a chopper which intermittently blocks the path between the object and a measuring electrode. When a vibrator such as a tuning fork is used as the chopper, the resonance frequency is determined depending upon the length and width of the vibrator then used. To keep the resonance frequency constant for all the vibrators thus used, an extremely high preciseness in machining the vibrators is required. This requirement is practically difficult to satisfy. As a result, the resonance frequency and therefore the phase of the detected AC signal varies undesirably from one vibrator to another. If a band-pass filter is used to filter off noise from the detected AC signal, then an undesirable variation in phase of the AC signal will be caused also by the irregularity in the quality of parts of which the filter is constituted.

DC type surface potential measuring meters are also known in the art. For example, U.S. Pat. Nos. 4,100,484; 4,106,869 and 4,063,154 have disclosed feedback type surface potential measuring meters. In this type of known surface potential measuring meter, the detected voltage induced in a measuring electrode is amplified by a high voltage amplifier circuit and the same voltage as the measured one is fed back to the housing of the measuring electrode. This type of electrometer has an advantage that the potential difference between the meter and the object remains always at 0 V and therefore it is made possible to detect the surface potential without being affected by the distance between the meter and the object to be measured.

However, the known meters also have some disadvantages. Generally speaking, the feedback control system is apt to become unstable and oscillate, in particular when the open-gain by the high voltage amplifier is very large. For example, when a DC-DC inverter is used as the amplifier, the inverting transformer suddenly becomes unstable in oscillation and tends to stop when the input voltage is dropped to a certain level. This results in an abrupt drop in output because the linearity of the input/output characteristic is lost. This is equivalent to an abrupt increase of gain by amplification. Consequently, if negative feedback is applied at this point, then the negative feedback system becomes unstable causing oscillation of the detection output.

In prior art, various electrostatic recording apparatuses have been proposed in which the potential of latent image formed on a recording medium is detected and the detected signal is used to control the conditions necessary for image formation. For example, reference is made of U.S. Pat. Nos. 3,788,739 and 3,438,705.

For this known type of electrostatic recording apparatus it is known that stability and reliability of control on the image formation can be improved very much by treating the control data employing a digital computer. However, use of a microcomputer for sequence control involves some difficulties. When the function of controlling potential is added to the microcomputer, the number of input-output ports allocable for the potential control is very small since the greater part of the input-output ports must be allocated for sequence control of key entry, display and various image forming means. Therefore, the control of potential, if made possible, is limited within a very narrow range and only uniformalized controls can be realized employing such microcomputer.

It is also expected that stability and reliability of control on the above mentioned type of electrostatic recording apparatus can be further improved by controlling the output of the high voltage charger employing a digital computer. However, the output of such digital computer is unsteady and variable depending upon the initial state until the computer has been initialized, that is, until its output port has been reset. In this unstable state of the output it is required to keep the high voltage charger off. Otherwise, an unsteady control voltage may be applied to the high voltage charger and thereby the recording medium may be brought into an undesired condition.

Use of a digital computer in the arithmetic operation of the measured surface potential will also bring forth substantial improvement in stability and reliability of control on the electrostatic recording apparatus. However, in this case, if any trouble occurred in the electrometer or in the potential measuring circuit or in its A/D converter, then the digital computer would no longer receive the correct measured data of surface potential. As a result, the output for controlling the high voltage charger or for controlling the bias voltage for development would be an abnormal value which may produce images of poor quality.

If the high voltage output from the high voltage charger becomes abnormally high, then the corona discharge is changed into a glow discharge which may damage the surface of the recording medium and/or the high voltage generator of the charger itself. For this reason it is a common practice in the art to provide a breaker in the apparatus. When the input to the high voltage generator exceeds a certain predetermined value, the breaker inhibits the generator from issuing any output to prevent the damage. However, actuation of such breaker causes interruption of the image forming operation within the apparatus. If such breaker is frequently actuated, the reliability of the apparatus may be lost completely.

SUMMARY OF THE INVENTION

Accordingly it is a general object of the present invention to provide a surface potential measuring meter which eliminates the disadvantages involved in the prior art mentioned above and also to provide an electrostatic recording apparatus provided with such improved meter for measuring the surface potential of latent images.

More particularly, it is an object of the invention to provide a surface potential measuring meter which enables DC restoration of a detected AC signal in a stable manner whose phase may be different from one meter to another, by adjusting the phase of a synchronizing signal obtained from the chopper driving signal of the meter.

It is another object of the invention to provide a surface potential measuring meter by which trouble or abnormality in operation of the chopper and the chopper driver of the meter can be detected very easily.

It is a further object of the invention to provide a surface potential measuring meter having a feedback loop to the chopper of the meter which includes a limiter circuit for limiting the level of the input voltage to the high voltage amplifier within a range where the amplifier can operate in a stable manner so as to prevent any breaking of the loop in said feedback loop circuit.

It is still a further object of the invention to provide an electrostatic recording apparatus which is provided with a computer having a program for potential control and a computer having a program for sequence control and in which said computers are operable independently of each other.

It is an even further object of the invention to provide an electrostatic recording apparatus which includes a circuit for limiting the input to the high voltage transformer of the high voltage charger prior to actuation of a breaker provided for said high voltage transformer.

Other and further objects, features and advantages of a the invention will appear more fully from the following description with reference to the accompanying drawings.

BRIEF DESCRIPTION OF THE DRAWINGS

FIG. 6 is a right hand cross-section along the line X—X' in FIG. 5;

FIG. 7 is a left cross-section along the line X—X' in FIG. 5;

FIG. 8A is a perspective view of the electrometer;

FIG. 8B is a cross-section of the vibrator 82 thereof;

FIGS. 19A-1 and 19A-12, 19B-1 and 19B-2, 19C-1 and 19C-2, 19D-1 and 19D-2, and 19E-1 and 19E-2 show in combination flow charts of programs arranged as in FIGS. 19A-19E, respectively.

Figure 19A:
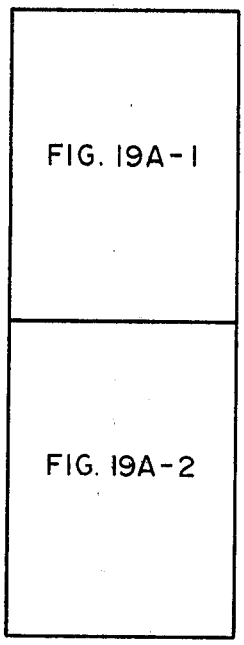
FIGS. 19A–19E show arrangements of flow charts of programs stored in CPU 2.
Figure 19B:
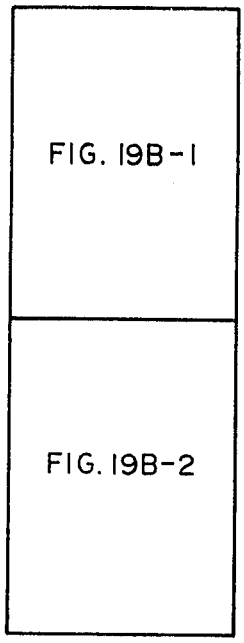
Figure 19C:
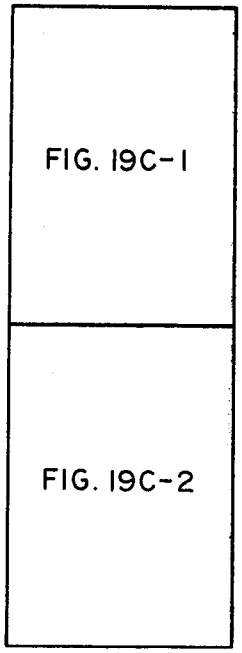
Figure 19D:
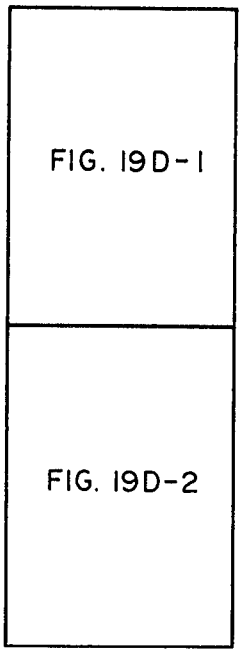
Figure 19E:
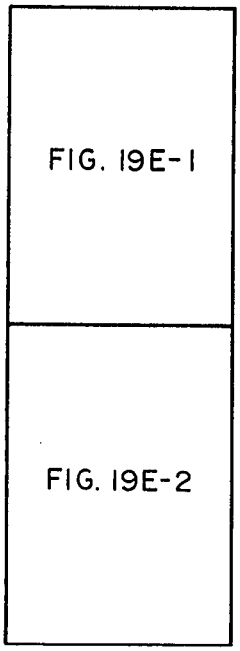
Figures 1, 19A:
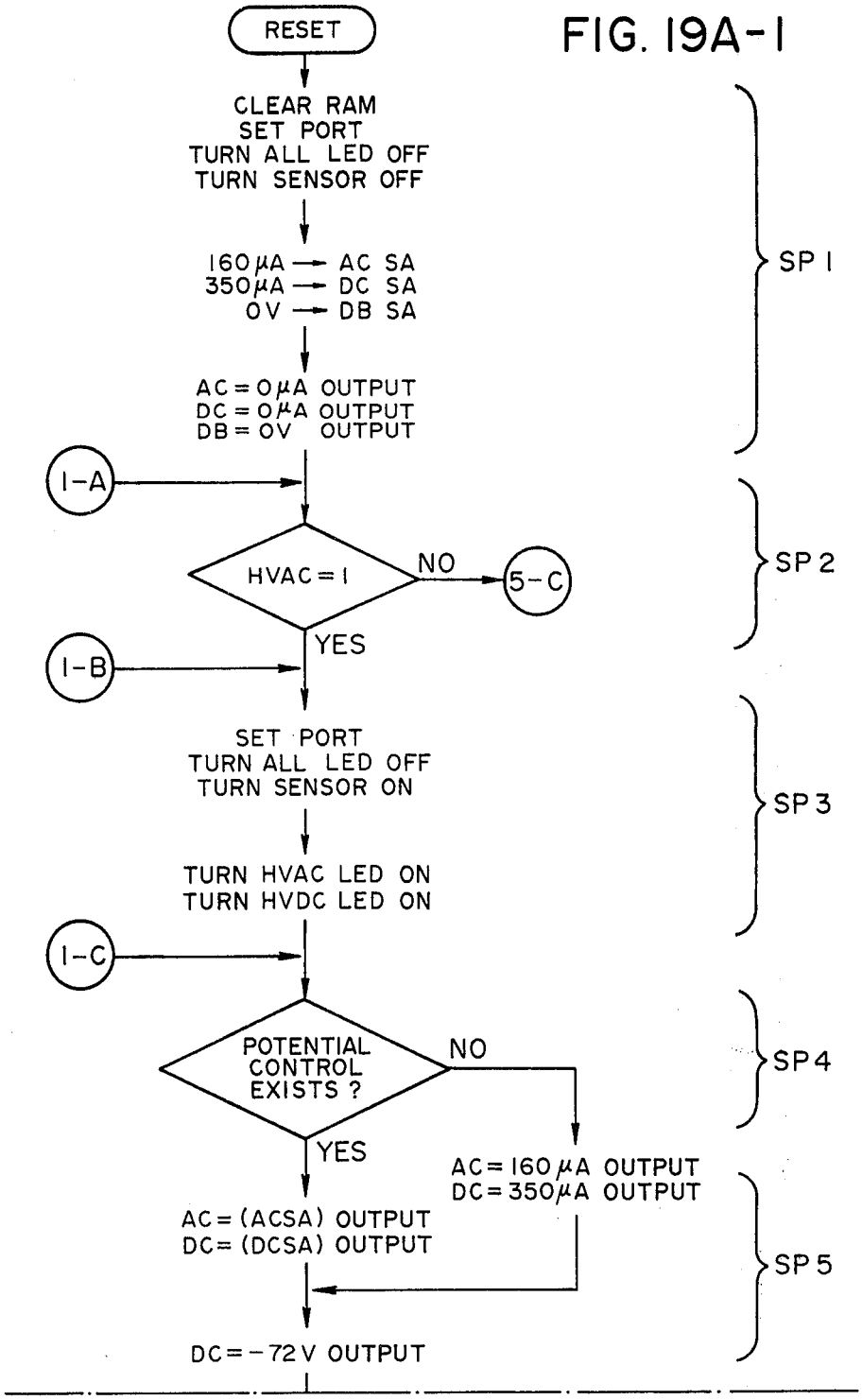
Figures 2, 19A:
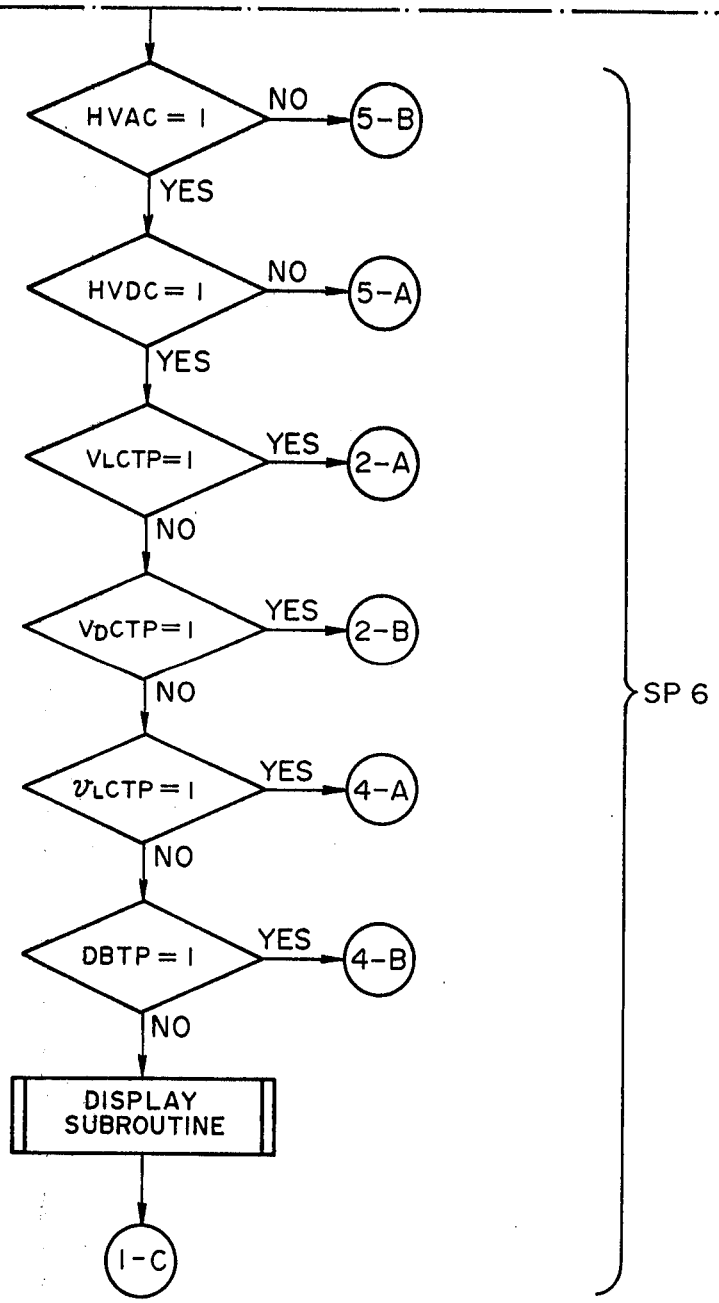
Figures 1, 19B:
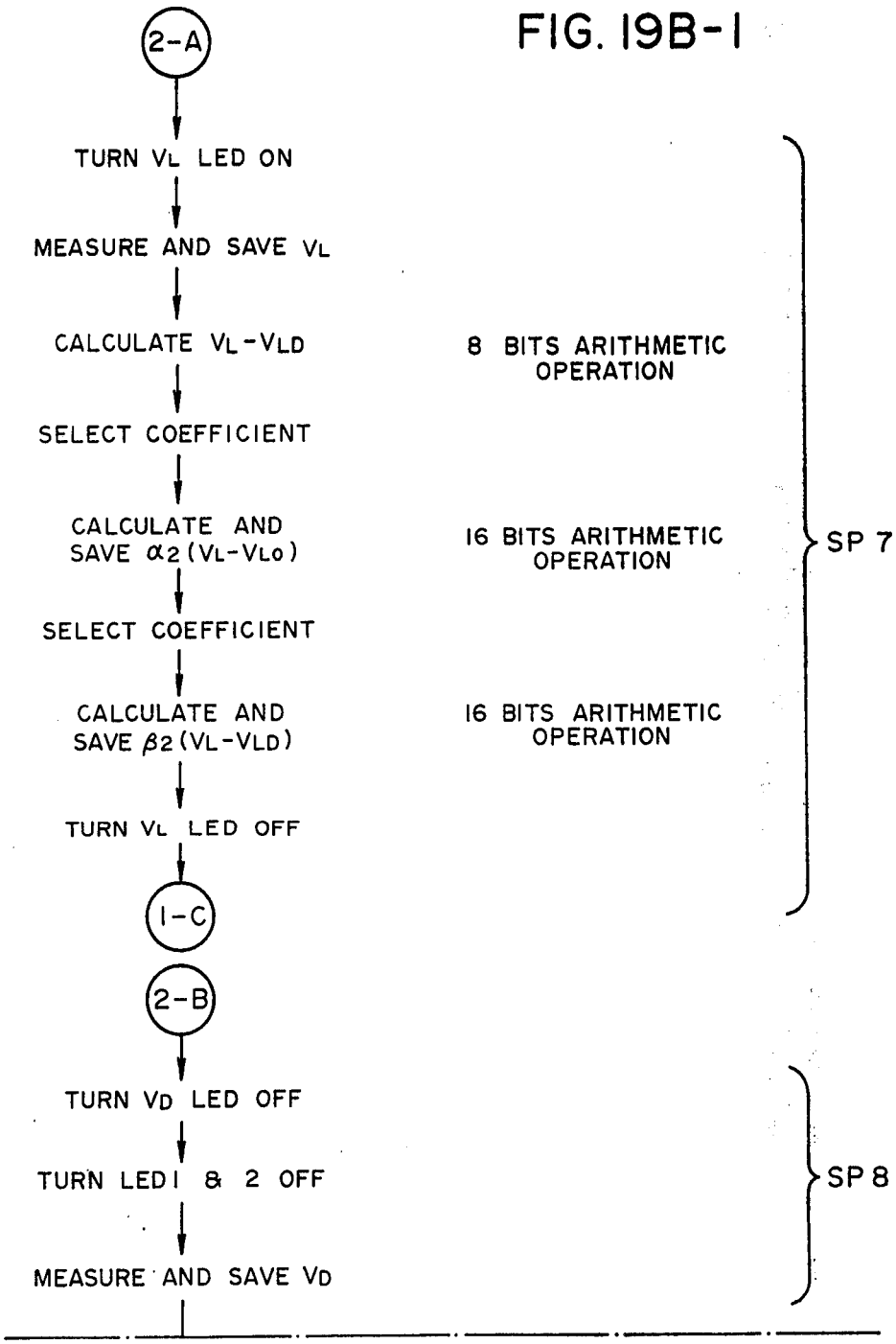
Figures 2, 19B:
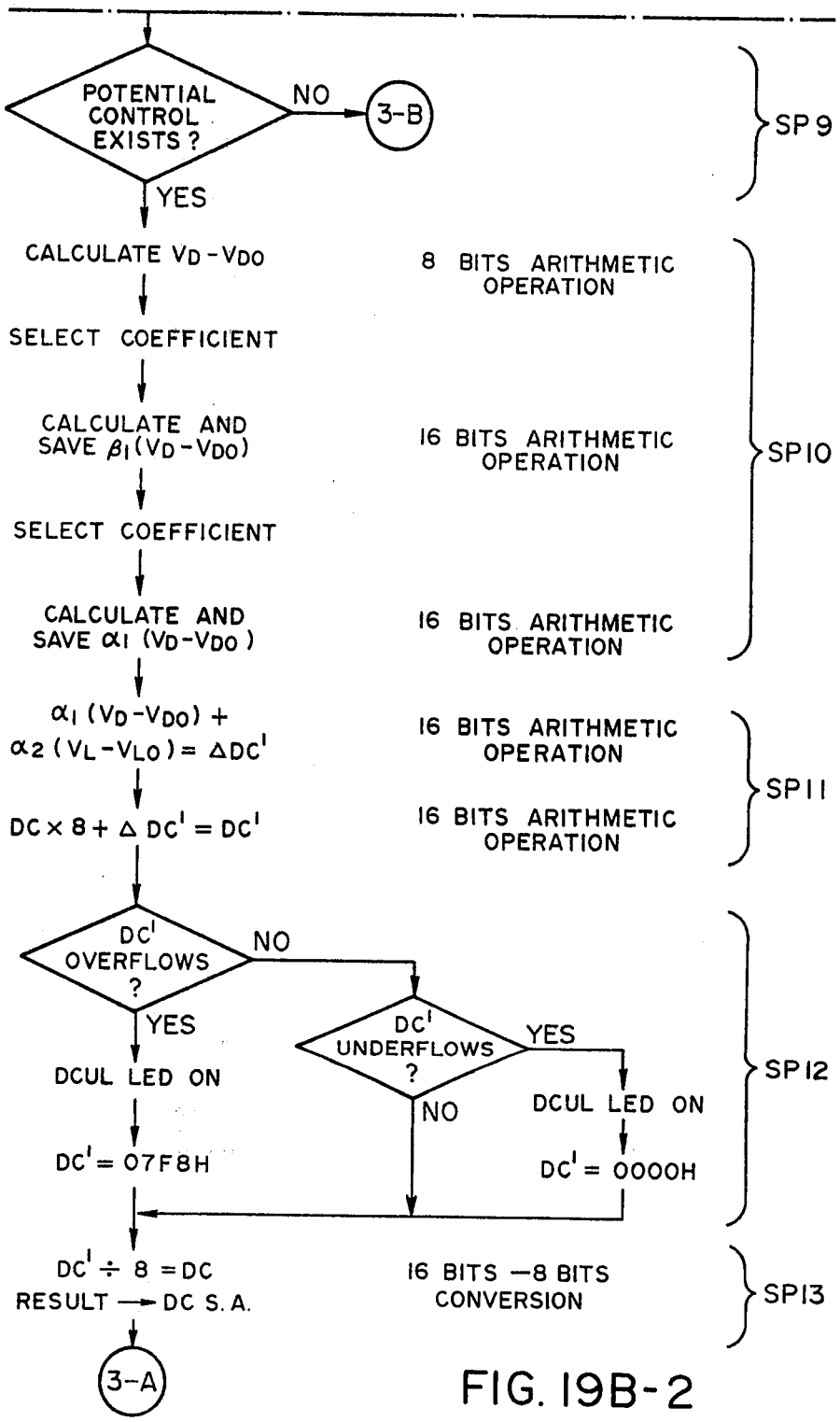
Figures 1, 19C:
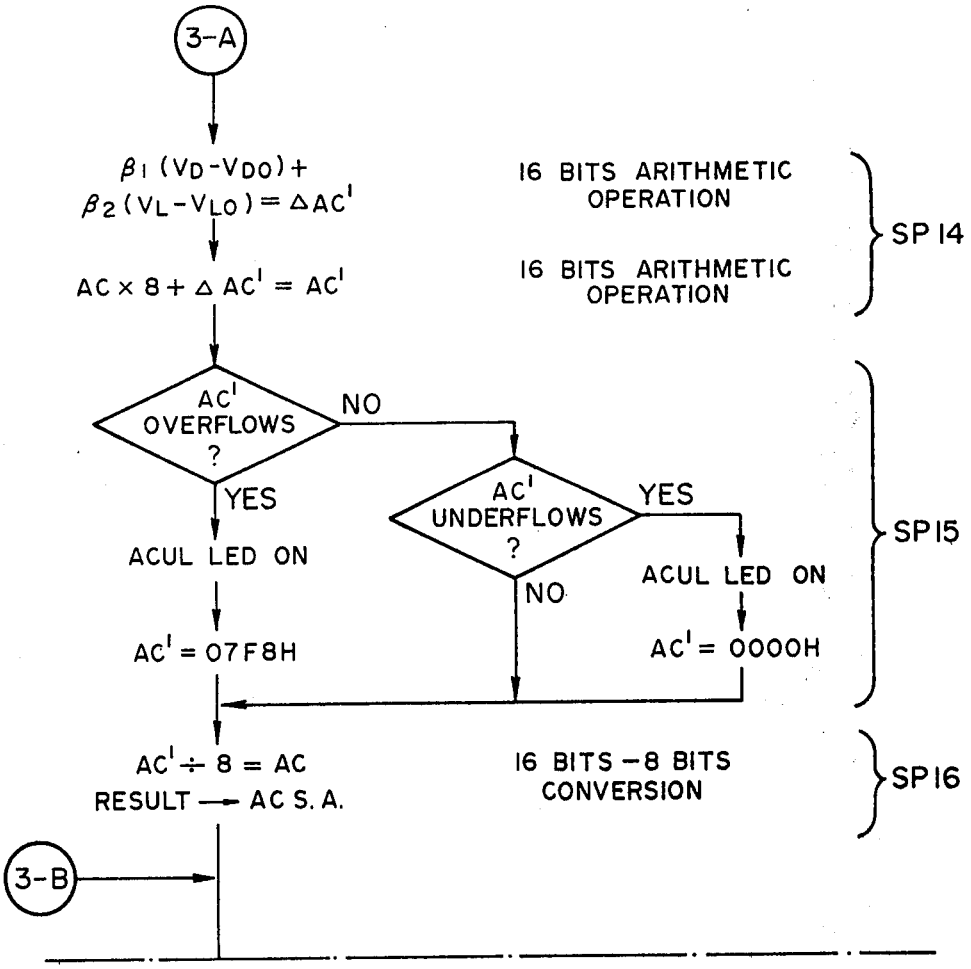
Figures 2, 19C:
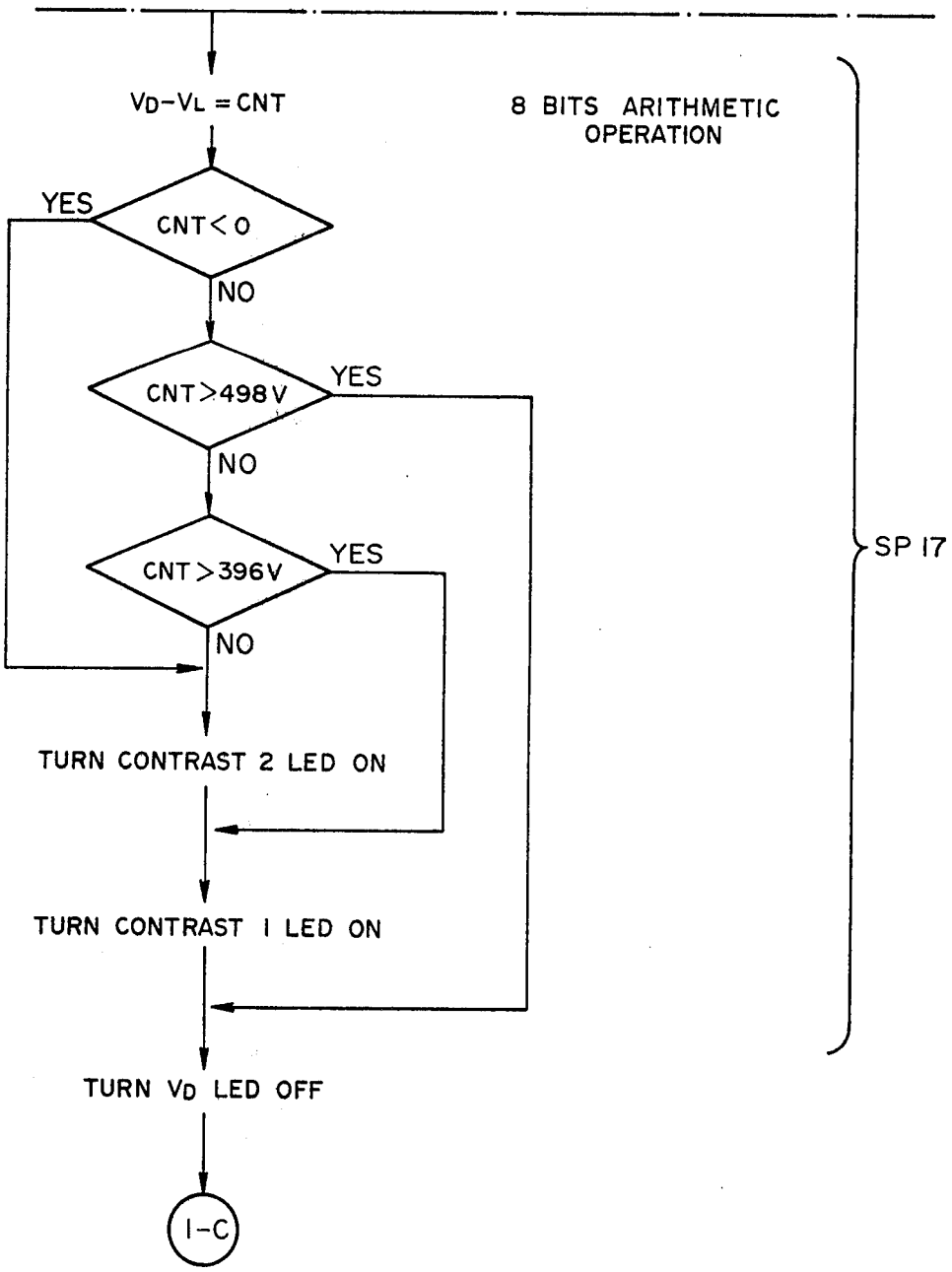
Figures 1, 19D:
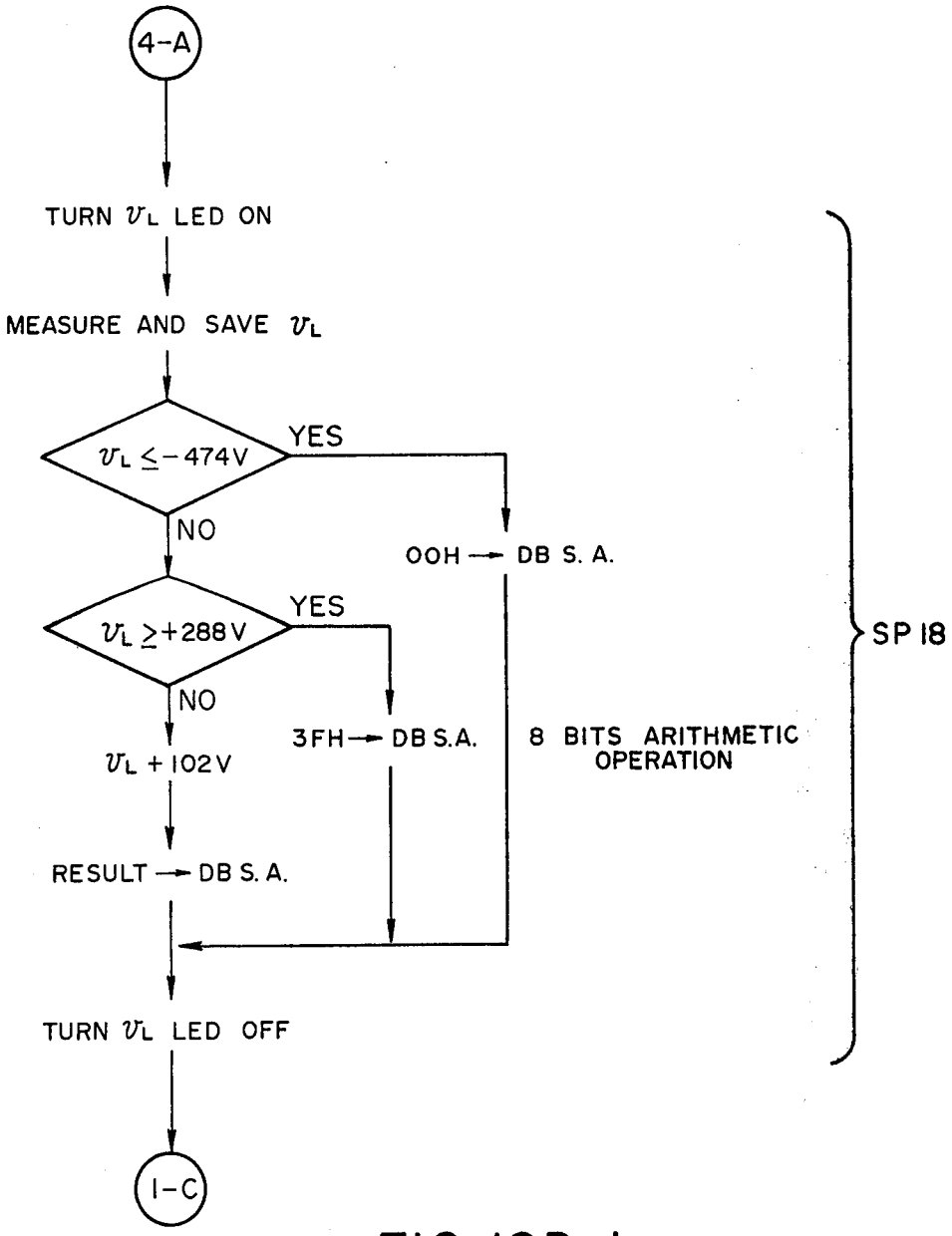
Figures 2, 19D:
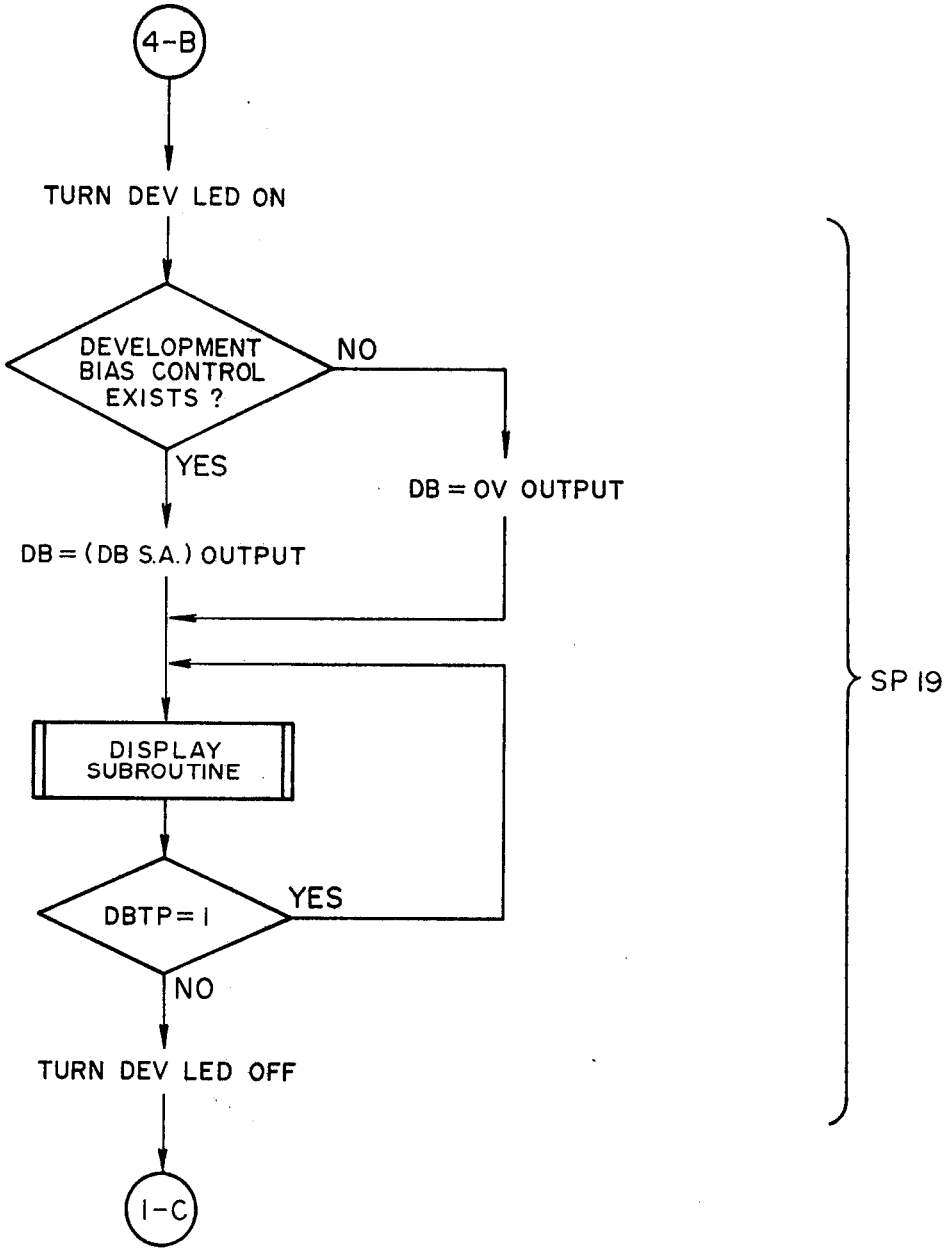
Figures 1, 19E:
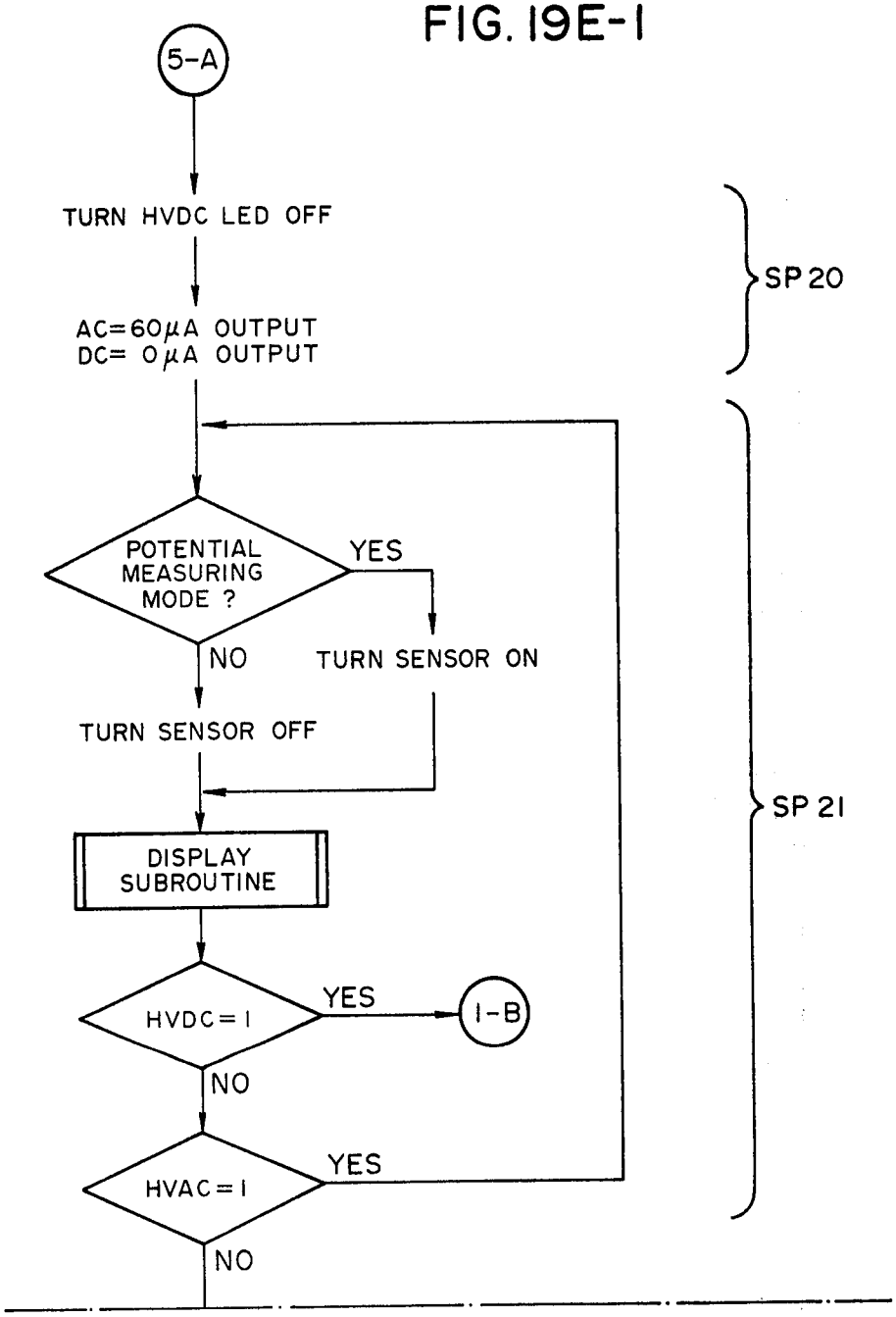
Figures 2, 19E:
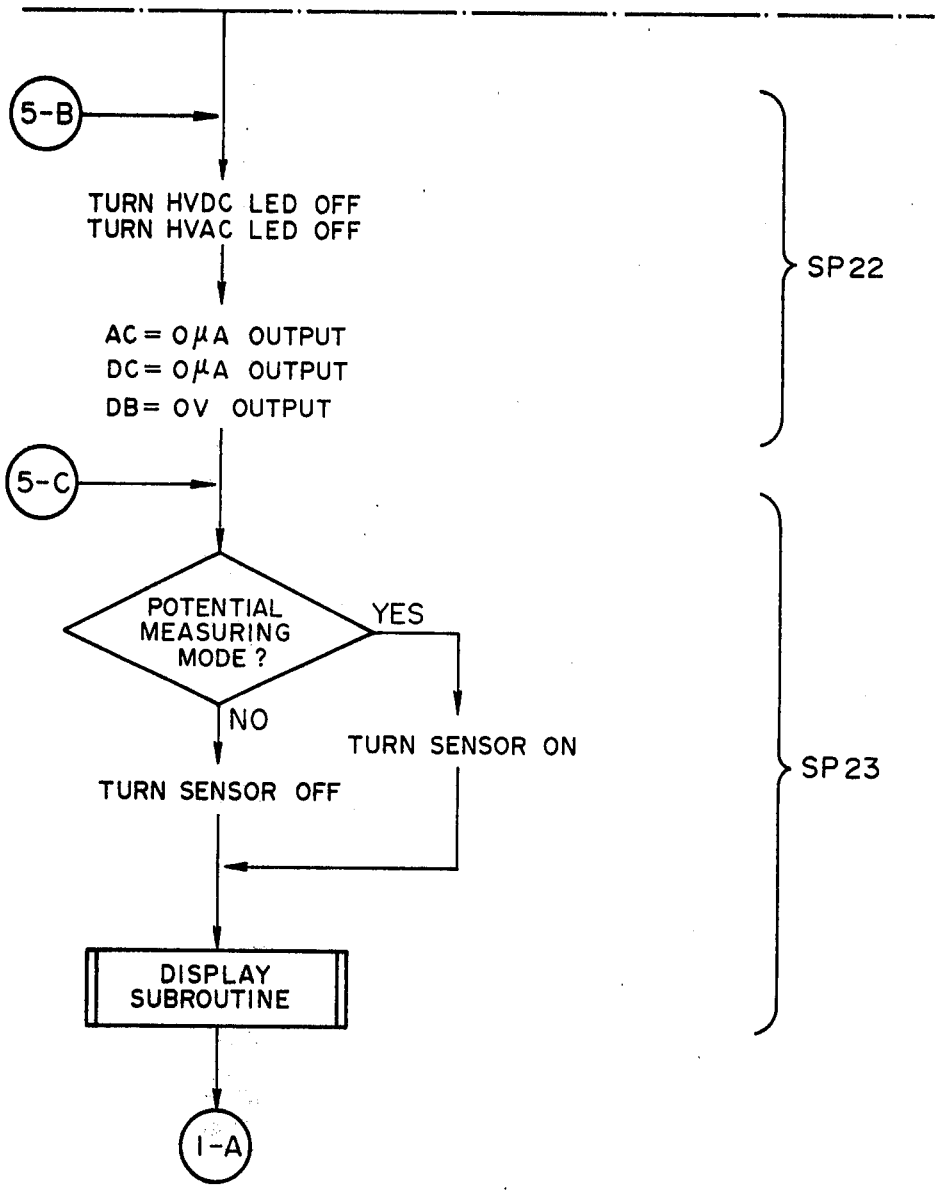

Referring first to FIG. 1 showing a copying apparatus to which the present invention is applicable, reference numeral 47 designages a drum composed of a three-layer photosensitive medium formed using a CdS photoconductive substance. The drum is rotatably mounted on a shaft and driven into rotation in the direction of the arrow by a main motor 71 which is in turn actuated by keying a copy key on.

After the drum 47 is rotated by a predetermined angle, an original placed on an original table made of glass 54 is illuminated by an illumination lamp 46 which has a first scanning mirror 44 formed integrally therewith. The reflected light from the original is scanned by the first mirror 44 and a second scanning mirror 53. During scanning, the first and second scanning mirrors are moved in the speed ratio of 1:½ so that the optical length at the upstream side of lens 52 can be kept constant.

The reflected light image is focused on the drum 47 at the exposure part through the lens 52 and a third mirror 55.

The surface of the drum 47 is subjected to simultaneous discharging treatments by a pre-exposure lamp 50 and a pre-AC charger 51' and then subjected to corona charging (for example with + polarity) by a primary charger 51. Thereafter, at the above mentioned exposure part, the drum 47 is subjected to slit exposure to the image illuminated by the lamp 46.

Simultaneously with the slit exposure, corona discharging with AC or the opposite polarity (for example −) to that of the primary one is carried out on the drum by a discharger 69. Thereafter, the drum is further subjected to whole surface exposing by a whole surface exposure lamp 18 to form a high contrast electrostatic latent image on the drum 47. The latent image thus formed on the drum is visualized as a toner image by developing roller 65 of developing device 62 using liquid developer. The toner image is subjected to the pre-treatment by a pre-transfer charger 61 so as to make the toner image ready for transferring.

Transfer sheets are contained in upper and lower cassettes 10 and 11 depending upon the format of paper sheet. From the cassette 10 or 11 the transfer sheet is fed into the machine by a paper feed roller 59 and transported to the drum 47. At the time, a register roller 60 determines the timing of sheet transportation to the drum so that the fore edge of the sheet and that of the latent image can be correctly with each other at the transfer station.

The transfer sheet is guided to the area between a transfer charger 42 and the drum surface. At this step, the toner image is transferred onto the transfer sheet from the drum.

After transferring, the transfer sheet is stripped from the drum surface by a separation roller 43 and then guided to a conveying roller 41 which conveys the sheet to the gap between pressing rollers 40 and 41 and a heating plate 38 where the toner image is fixed under the action of pressure and heat. After fixing, the sheet is discharged from the machine to a tray 34 by a discharging roller 37 passing through a sheet detecting roller 36.

On the other hand, after transferring, the drum 47 continues rotating and is advanced to the cleaning station. At the cleaning station there is provided a cleaning device comprising a cleaning roller 48 and an elastic blade 49 which cleans the drum surface. After cleaning, the drum is advanced to the next copying cycle.

Designated by 67 is a surface potential measuring meter 67 which is disposed in the vicinity of the surface of the drum 47 between the whole surface exposing lamp 18 and developing device 62.

Prior to the start of the above described copying operation cycle, some pre-treatment steps must be carried out which are described in detail hereinafter.

At first, a pre-wet step must be carried out after turning the power source switch on. At this step, an amount of the liquid developer is poured onto the cleaning blade 49 to flow out of the remaining toner accumulated about the blade and also to make the contact surface between the blade 49 and drum 47 lubricant. This pre-wet step continues about four seconds during which the drum remains stopped.

After the pre-wet step, the drum is driven into rotation to erase the remaining electric charge and memory on the drum by the pre-exposure lamp 50 and pre-AC discharger 51' and also to clean the drum surface by the cleaning roller 48 and cleaning blade 49. This step is hereinafter referred to as pre-rotation step. This pre-rotation step is required to give the drum 47 a proper sensitiveness to light and a clean surface prepared for image formation. Pre-wet time and pre-rotation time (number of rotations) vary depending upon various automatic operational conditions.

Also, after completion of a pre-set number of copying cycles, an after-treatment step must be carried out. This after-treatment step involves erasing the electric charge and memory remaining on the drum by the action of AC charger 69 etc. and cleaning the drum surface while rotating the drum several times. This step is hereinafter referred to as post-rotation step LSTR. This step is required in order to stand the drum 47 in an electrostatic state, as well as to mechanically clean it.

In FIG. 1, reference numeral 70 designates a blank exposure lamp unit, the function of which is described hereinafter in detail with reference to FIG. 1B.

Figure 1A:
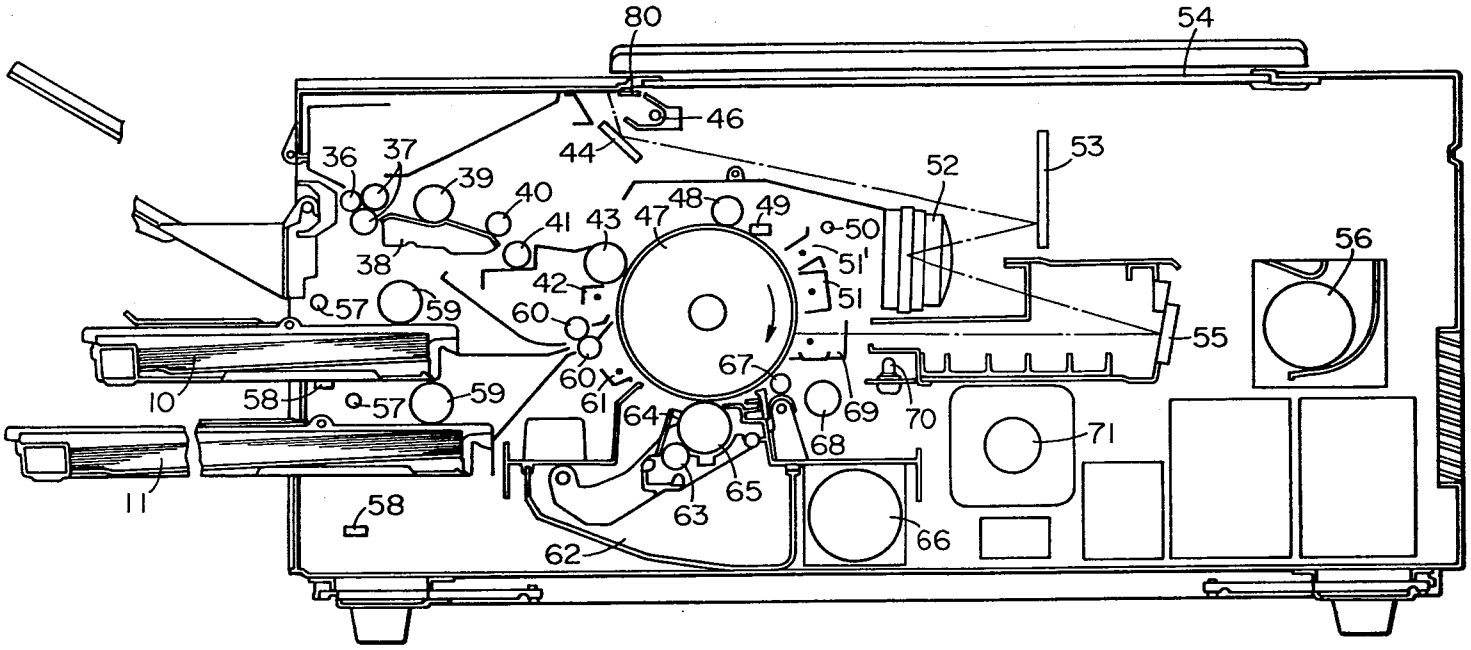
FIG. 1A is a sectional view of a copying machine to which the present invention is applicable.
Figure 1B:
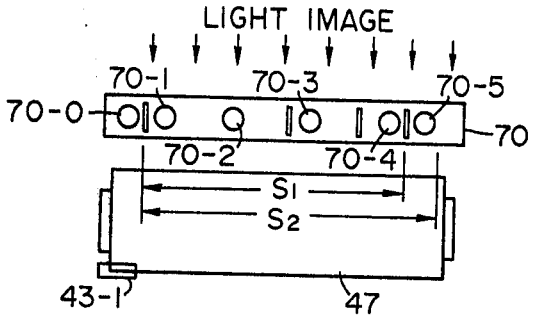
FIG. 1B is a detailed plan view of a part thereof including blank exposure lamps.

As shown in FIG. 1B, the lamp unit 70 comprises blank exposure lamps 70-1 to 70-5 which are put on during rotation of the drum but not during imagewise exposure. These lamps serve to erase electric charge on the drum surface and thereby prevent any unnecessary surplus toner from adhering onto the drum surface. Among the five lamps, however, the first blank exposure lamp 70-1 is disposed to illuminate the area of the drum corresponding to the surface potential measuring meter 67 and therefore it is stopped for a moment while the potential on the dark portion is measured by the meter 67. Also, if copy making is carried out using copying paper of B-format the picture area of which is smaller than those of format A4 and A3, the lamp 70-5 remains on even when the optical system is running. The lamp unit further comprises a so-called sharp cut lamp 70-0 which is disposed to illuminate the portion of the drum in contact with the separation guide plate 43-1. The function of this sharp cut lamp is to completely erase the electric charge on said portion of the drum and thereby prevent adhesion of any toner to said portion so that the separation marginal portion can be kept clean. This sharp cut lamp remains on at all times during the rotation of the drum.

Figure 2:
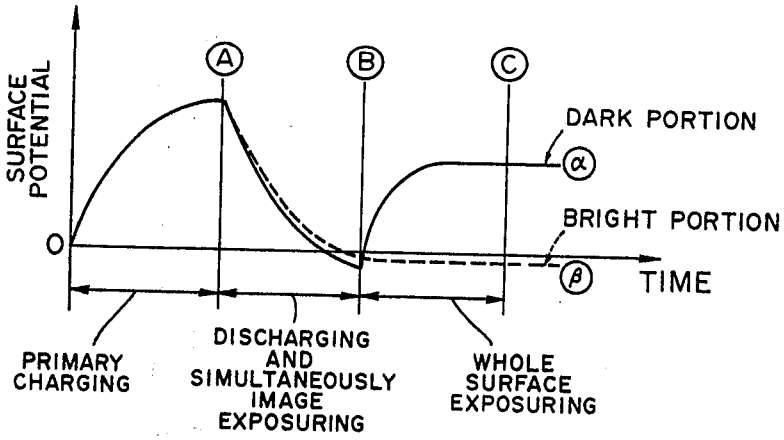
FIG. 2 is a characteristic curve showing the surface potentials on the respective portions of the photosensitive drum.

In the electrophotographic copying machine described above, the surface potential on the drum changes when the drum passes through the above copying process steps. Changes of the surface potential on the area of the drum corresponding to the bright portion of original where light is greatly reflected and on the area corresponding to the dark portion of original where light is less reflected, are illustrated in FIG. 2. The surface potentials necessary for forming a final electrostatic latent image are those at the point Ⓒ in FIG. 2. In the shown example, at the point Ⓒ, the surface potential on the dark portion is at a level of $\alpha$ whereas that on the bright portion is at $\beta$.

Figure 3:
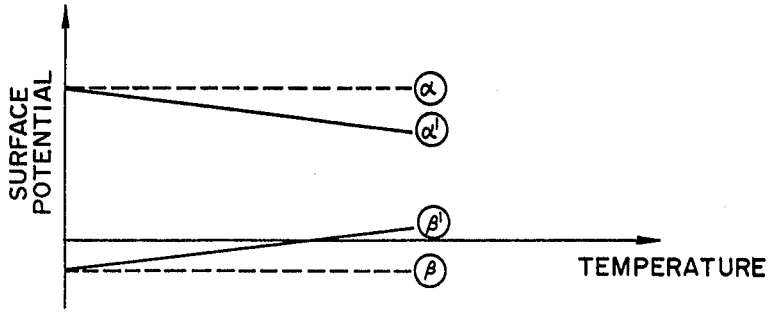
FIGS. 3 and 4 are characteristic curves showing changes in surface potentials with temperature and with time.
Figure 4:
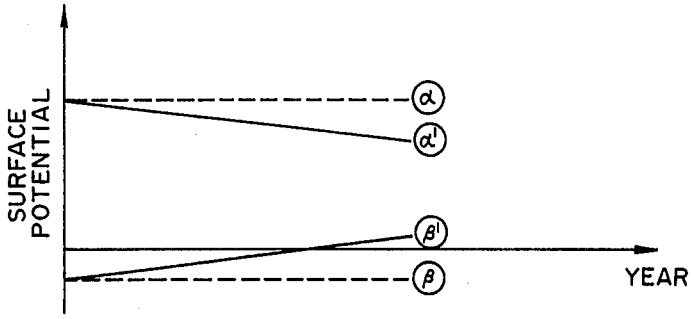
Figure 5:
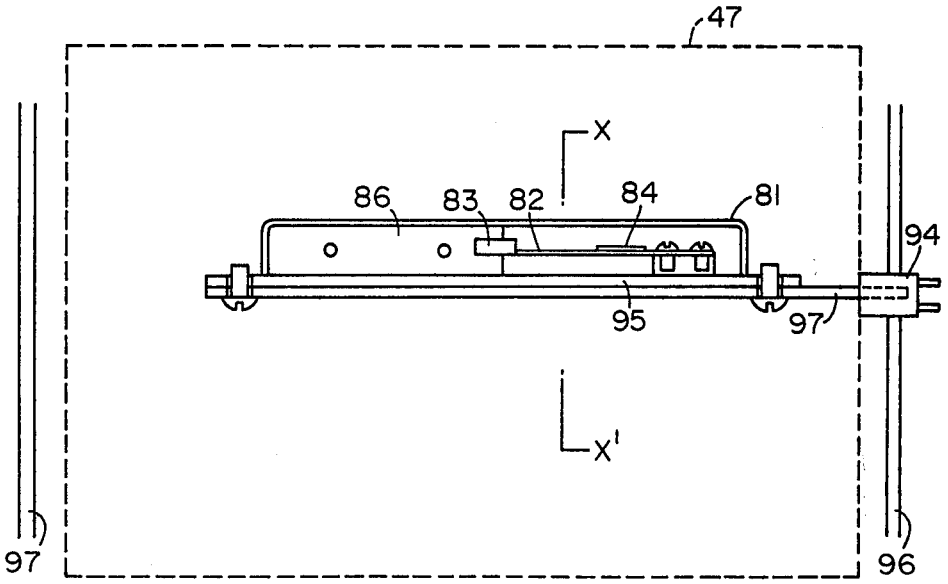
FIG. 5 is a schematic side view of a surface potential measuring meter.

However, these values of surface potential change to $\alpha$ and $\beta$ with a rising of temperature surrounding the drum 47 as shown in FIG. 3. Also, the surface potentials $\alpha$ and $\beta$ change to $\alpha'$ and $\beta'$ with secular change of the drum 47 (with year) as shown in FIG. 4.

To compensate for such change of surface potential with temperature or with yearly aging of the drum, a surface potential measuring meter has sometimes been used, as in the case of the shown example. The output from the meter detecting the surface potential is used to control the exposure value, thereby controlling the voltage for charging and bias for developing then to be used.

The surface potential measuring meter according to the invention will be described in detail hereinafter with reference to FIGS. 5 through 8.

In these figures, reference numeral 81 designates a metal casing and 95 is a metal base member with which casing and base the meter is completely covered to exclude any adverse effect of external electric field.

The casing 81 has an opening serving as a measuring window 88. The window 88 is disposed facing the measured portion of drum 47.

The base member 95 has a vibrator 82 in the form of a tuning fork electroconductively mounted thereon. Driving piezo-electric element 84-1 and feedback piezo-electric element 84-2 are connected to the driver circuit shown in FIG. 11 and a DC voltage is applied to the source terminal. Thereby, the vibrator 82 performs self-excited oscillation at its own mechanical resonance frequency. The tip end of one arm of the tuning fork is formed as a chopper electrode 83 which opens and closes the measuring window 88 periodically at certain constant intervals as the vibrator oscillates. At the inner side of the chopper electrode there is provided a stationary print board 86 on which a measuring electrode 85 is formed by a pattern of copper foil. The measuring electrode is disposed opposed to the measuring window and has the same shape as that of the latter.

Lines of electric force derived from the surface potential on the drum 47 enter the measuring electrode 85 passing through the window 88. However, with the oscillation of vibrator 82, the chopper electrode 83 moves across the electric lines of force between the window and the measuring electrode in a manner of interlinkage. As a result, an AC voltage is induced in the electrode 85. The induced AC voltage has an amplitude proportional to the difference in voltage between the surface potential on the drum 47 and that of the chopper electrode (which is at the same level as that of the shielding member).

The AC signal thus produced is introduced into a pre-amplifier circuit 101 formed of a source follower mounted in the print board 86. The pre-amplifier 101 converts the AC signal into a low impedance signal which is led to the exterior as an output of the electrometer.

In FIG. 8A, reference numeral 89 designates a shielding member provided within the casing 81 to prevent the driving signal to piezo-electric element 84 from flowing toward the measuring electrode 85. The piezo-electric elements 84-1 and 84-2 are disposed symmetrically, relative to the fulcrum of the vibrator 82 and cemented to the arms of the fork respectively by an electrically conductive bonding agent as shown best in FIG. 8A. Each of the piezo-electric elements 84-1, 84-2 is such a piezo-electric element which deforms in the direction of its surface when an electric field is applied thereto in the direction of its thickness. As shown in FIG. 8B, the piezo-electric element is sandwiched between a pair of electrodes 99. 98 is a layer of an electrically conductive bonding agent by which the piezo-electric element is fixed to the oscillating arm of the vibrator 82, which is made of an elastic metal piece such as phoshor bronze. Thus, the element, together with the oscillating arm, forms a unimorphic oscillator. Since the piezo-electric element has an elongated shape extending in the direction of the length of the oscillating metal piece, it is deformed in the direction of the length when an electric field is applied thereto. The driver circuit will be described hereinafter.

In mounting the meter on the body of the copying machine, the base 95 is fixed to a base plate 97 which is in turn supported on the machine body through a base plate connector 94 and a base plate guide 87.

The base plate 97 which is also a print board has, at its plug-in side portion, a connector contact terminal part formed by a pattern of copper foil through which a power source is supplied to the meter and also the output signal is taken out from the meter. Therefore, the electrometer can be plugged in and disconnected from the connector in a simple manner.

As described above, according to the invention, a tuning fork is driven by a piezo-electric element to intermittently cut out lines of electric force. This arrangement is compared with the prior art which needs a miniature motor machined with extremely high preciseness. Therefore, according to the invention, the manufacturing cost is markedly reduced as compared with the prior art and a substantial miniaturization of the apparatus can be attained. Moreover, since the resonance frequency of the piezo-electric element is constant, it is made possible to detect the surface potential with higher accuracy and control the apparatus based upon the accurate result of detection.

A concrete form of potential measuring circuit for the above surface potential measuring meter according to the invention is described in detail hereinafter with reference to FIGS. 9 and 10.

As previously described, an AC signal of high impedance is induced in the electrode 85 by intermittently shielding the electric field between the drum 47 and the electrometer 67 by the tuning fork vibrator 82. The signal is transformed into a low impedance signal S1 by the pre-amplifier 101. The output signal S1 from the pre-amplifier is filtered through a band-pass filter 102 to exclude noise component from the signal. Then, the signal is introduced into a clamp circuit 113 passing through an amplifier 103 and a photocoupler 104. The input signal S2 to the clamp circuit is somewhat changed in phase as compared with the signal S1. On the other hand, a vibrator driving signal is applied to the terminal 120 to bring the vibrator driving circuit 105 into operation through photocoupler 107 and vibrator driving switch 107. Thus, the vibrator 82 starts vibrating. Feedback signal S3 from the vibrator is put into a synchonizing circuit 108 composed of phase shifting circuit 108*a* and comparator 108*b*. Since the feedback signal S3 is phase shifted from signal S1 but in synchronism with S1, the phase is advanced by the phase shifting circuit 108*a*. After being compared by the comparator 108*a*, there is obtained a signal S5 which is then differentiated by a differential circuit 111 to form a synchronizing signal S6. The signal S6 is introduced into the clamp circuit 113 through a display circuit 112.

The clamp circuit 113 clamps the signal S2 by the synchronizing signal S6 to discriminate the surface potential or the drum 47 between positive and negative, thereby forming an output signal S7. The signal S7 is integrated by an integrator 114 to convert it into a DC signal. The DC signal is transformed into a high voltage by DC-DC inverter 116 passing through an inverter driving circuit 115. The output voltage from the DC-DC inverter is fed back to the vibrator 82 as well as to the casing 81 for the electrometer as a shield potential.

Considering the circuit extending from pre-amplifier 101 to inverter 116 as one amplifier, it will be understood that the amplifier functions as an inverting amplifier. Namely, the inverting amplifier operates in such manner that when the surface potential on the drum is lower than said shield potential the amplifier increases the latter and when the former is higher than the latter, it decreases the latter so as to finally bring the shield potential of the sensor and that on the drum to the same level.

Therefore, the output obtained by voltage dividing the shield potential by a voltage divider 117 becomes the surface potential on the drum. All of the circuit parts enclosed by the broken line 100 serve as a circuit which brings the output voltage from the inverter 116 into the reference voltage (ground) and is isolated from the external circuit part by photocouplers to prevent noise generation.

In other words, the output obtained by voltage dividing the sensor potential by the voltage divider 117 measures the surface potential on the drum.

Figure 9:
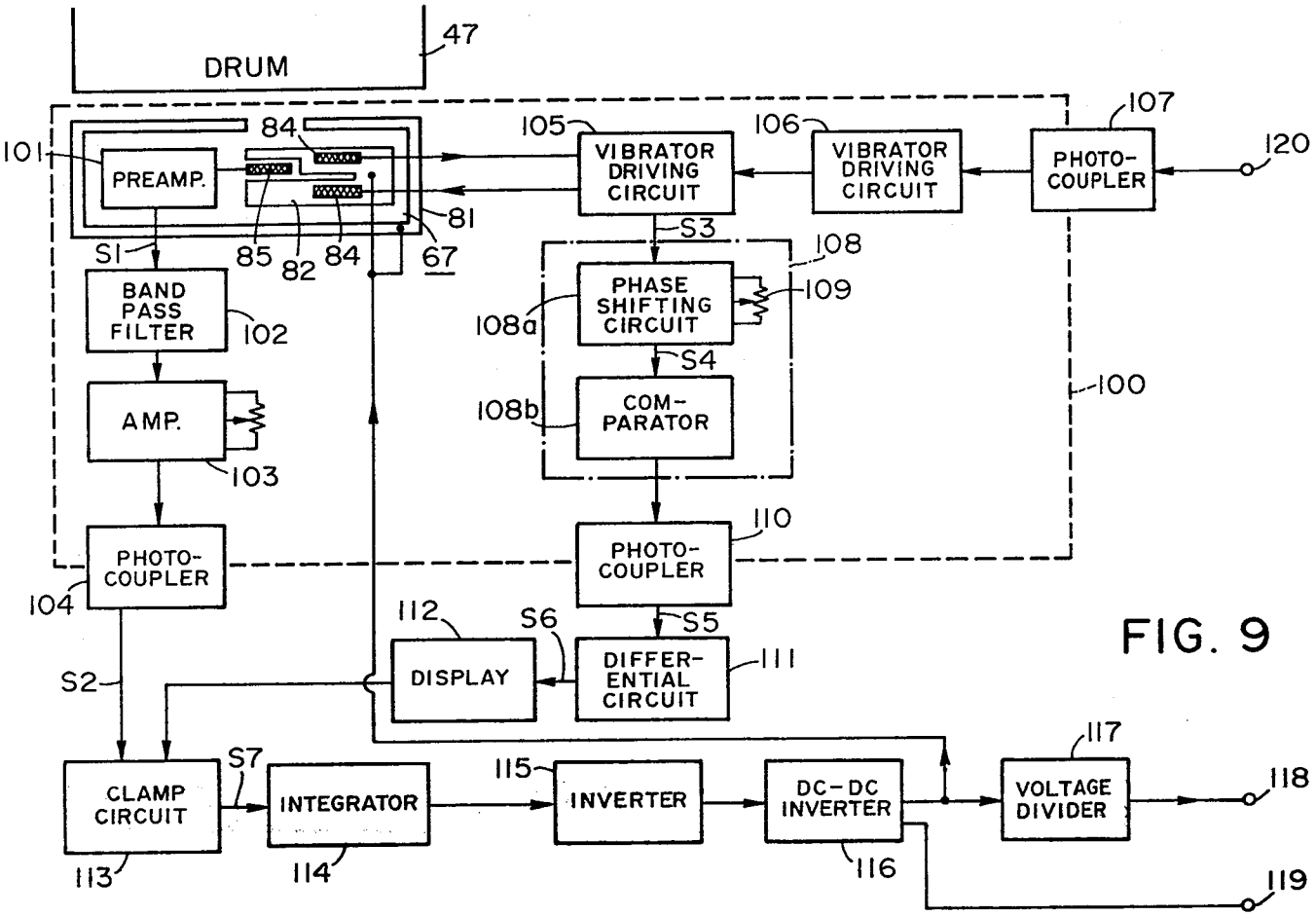
FIG. 9 is a block diagram of the potential measuring circuit.

Now, the respective circuits shown in FIG. 9 are described in detail with reference to FIGS. 11A and 11B, and 12A and 12B.

Figure 11:
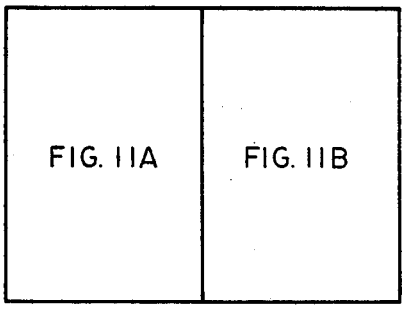
FIGS. 11A and 11B, and 12A and 12B show in detail the circuits of the respective parts of the circuit shown in FIG. 9 and arranged as depicted in FIGS. 11 and 12, respectively.
Figure 11A:
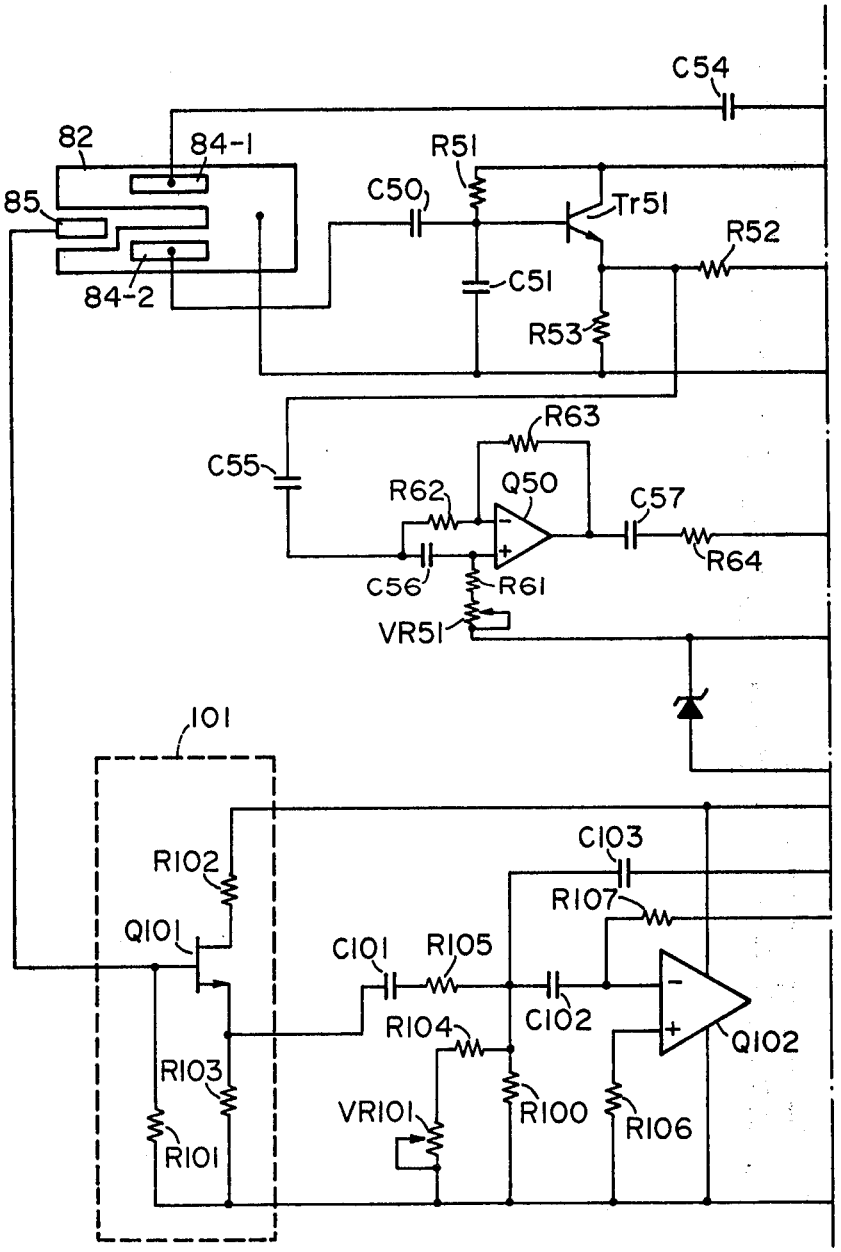
Figure 11B:
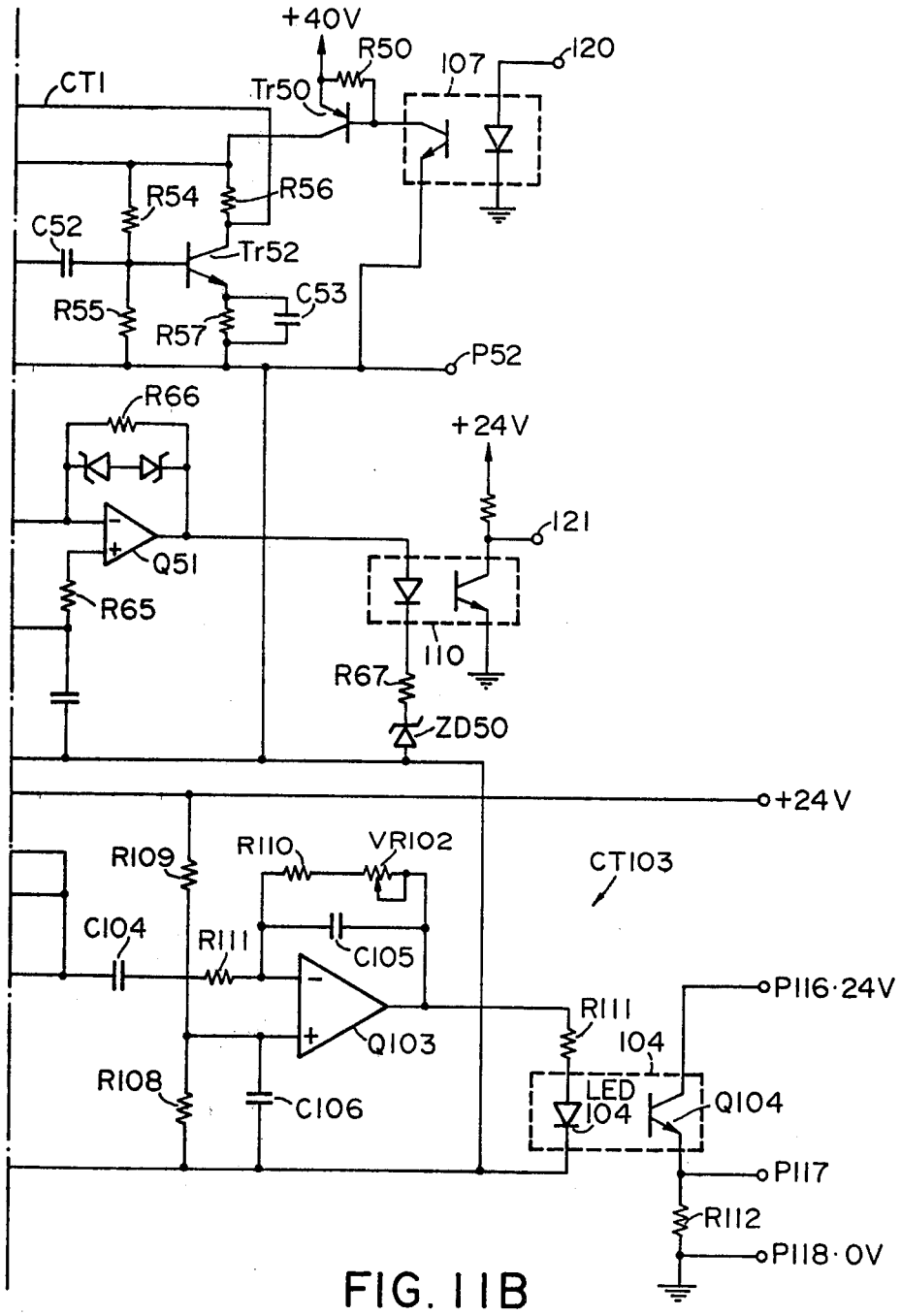

FIGS. 11A and 11B show a detailed circuit diagram of the part enclosed by the broken line 100 in FIG. 9. When a vibrator driving signal is applied to the terminal 120, it turns transistor Tr50 on by the photocoupler 107 composed of light emitting diode and photo transistor. Therefore, a power source Vcc is supplied to transistors Tr51 and Tr52. The vibrator 82 vibrates and a feedback signal is put out from the piezo-electric element 84-2 which is applied to the base of transistor Tr51 through a capacitor C50. The feedback signal is current amplified by Tr51 and then it is current amplified by Tr52 through resistor R52 and capacitor C52. The output from Tr52 drives the piezo-electric element 84-1 through capacitor C54. The above circuit, as a whole, forms an oscillation loop. The output from Tr51 is put into the phase shifting circuit through capacitor 55. Operational amplifier Q50 constitutes the main member of the phase shifting circuit.

The phase shifting circuit has a constant amplitude characteristic throughout the overall range of frequency and only its phase characteristic is a function of frequency. The phase shifting circuit shown in the embodiment is of primary type and is able to shift the phase within the range of about 0° to 180° by changing the variable resistor VR51. In this embodiment, VR51 is used as an adjusting volume for adjusting the timing of generation of synchronizing signal S6. By suitably setting VR51 a difference in phase deviation can be compensated. The difference in phase deviation may be caused by the difference in frequency of detection signal due to the shape of the vibrator and/or by irregularity in precision of components of the band-pass filter. Therefore, with this arrangement of the surface potential measuring meter, it is possible to compensate for the phase which is variable from one surface potential meter to another. Thereby, DC restoration of detection AC signal can be carried out in a stable manner. According to the prior art, as disclosed in U.S. patent application Ser. No. 951,330 filed on Oct. 31, 1978, the position of the chopper is detected optically or magnetically, which requires an extremely high accuracy in designing the chopper. It is expensive and difficult to adjust. In contrast, according to the above embodiment of the invention, accurate adjustment of timing can be carried out in a simple manner since the synchronizing signal is obtained from the chopper driving signal.

Output signal S4 from the phase shifting circuit which is an AC signal is compared by the comparator comprising an operational amplifier Q51 as the main component, zero-cross point is detected as the edge portion of output square wave and the output is transmitted to photocoupler 110. On the other hand, the high impedance measuring signal induced in the measuring electrode 85 is transformed into a low impedance signal. The signal is amplified while excluding noise from the signal by a multiple feedback type band-pass circuit comprising an operational amplifier Q102 as its main component. Variable resistor VR101 is used to adjust the central frequency of the filter. Output from Q102 is further amplified by operational amplifier Q103 passing through capacitor C104. The amplified output makes the light emitting diode LED101 of photocoupler 104 emit light with a brightness corresponding to the measuring signal. Variable resistor VR102 adjusts the gain by amplification. Output S2 whose level corresponds to the current flowing through the photo transistor Q104 of photocoupler is introduced into the clamp circuit.

Figure 12:
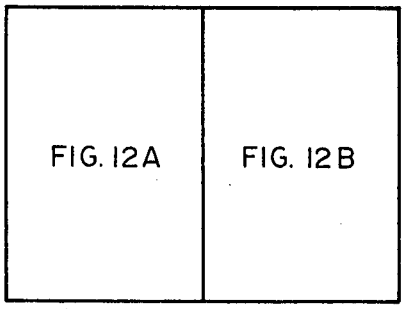
Figure 12A:
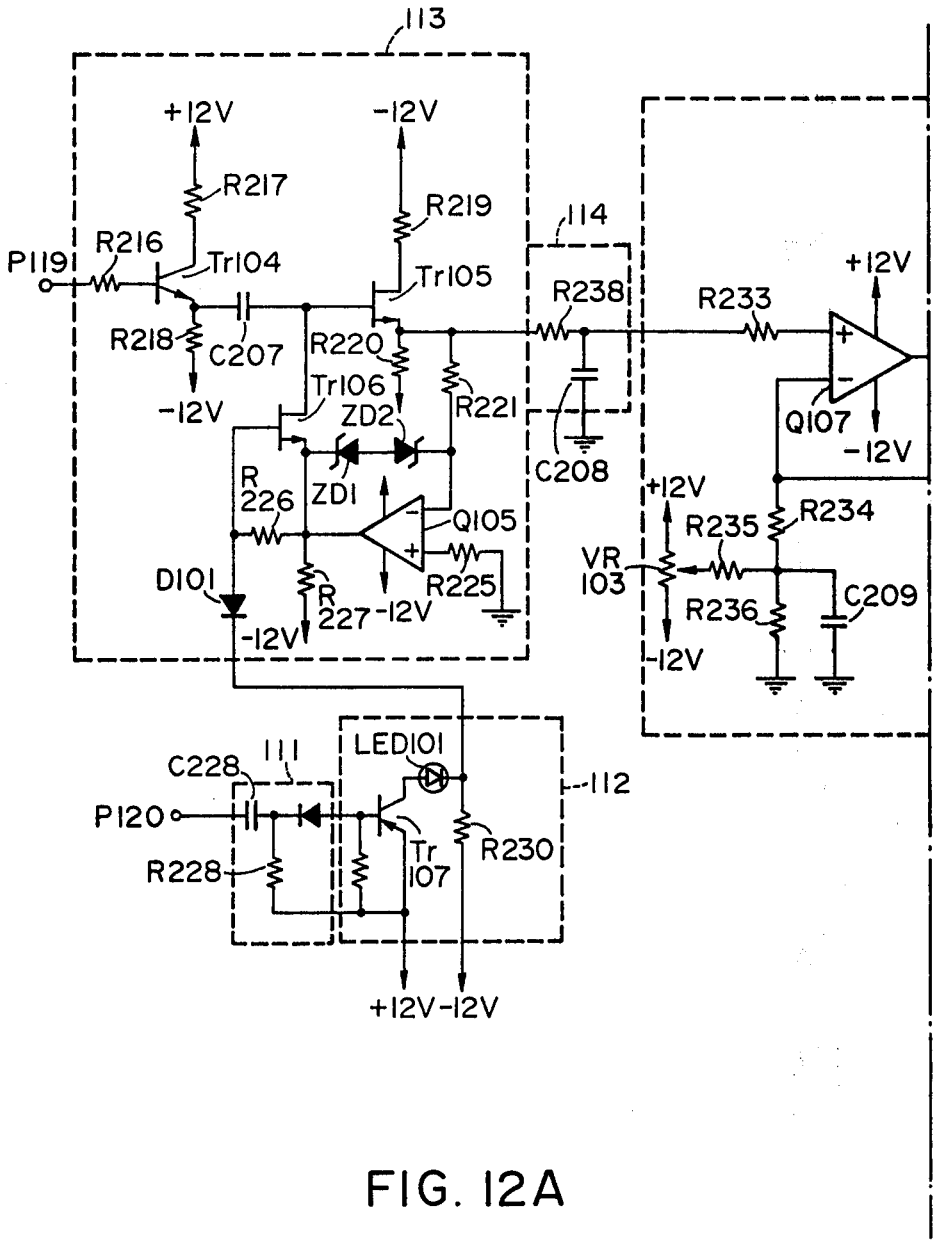
Figure 12B:
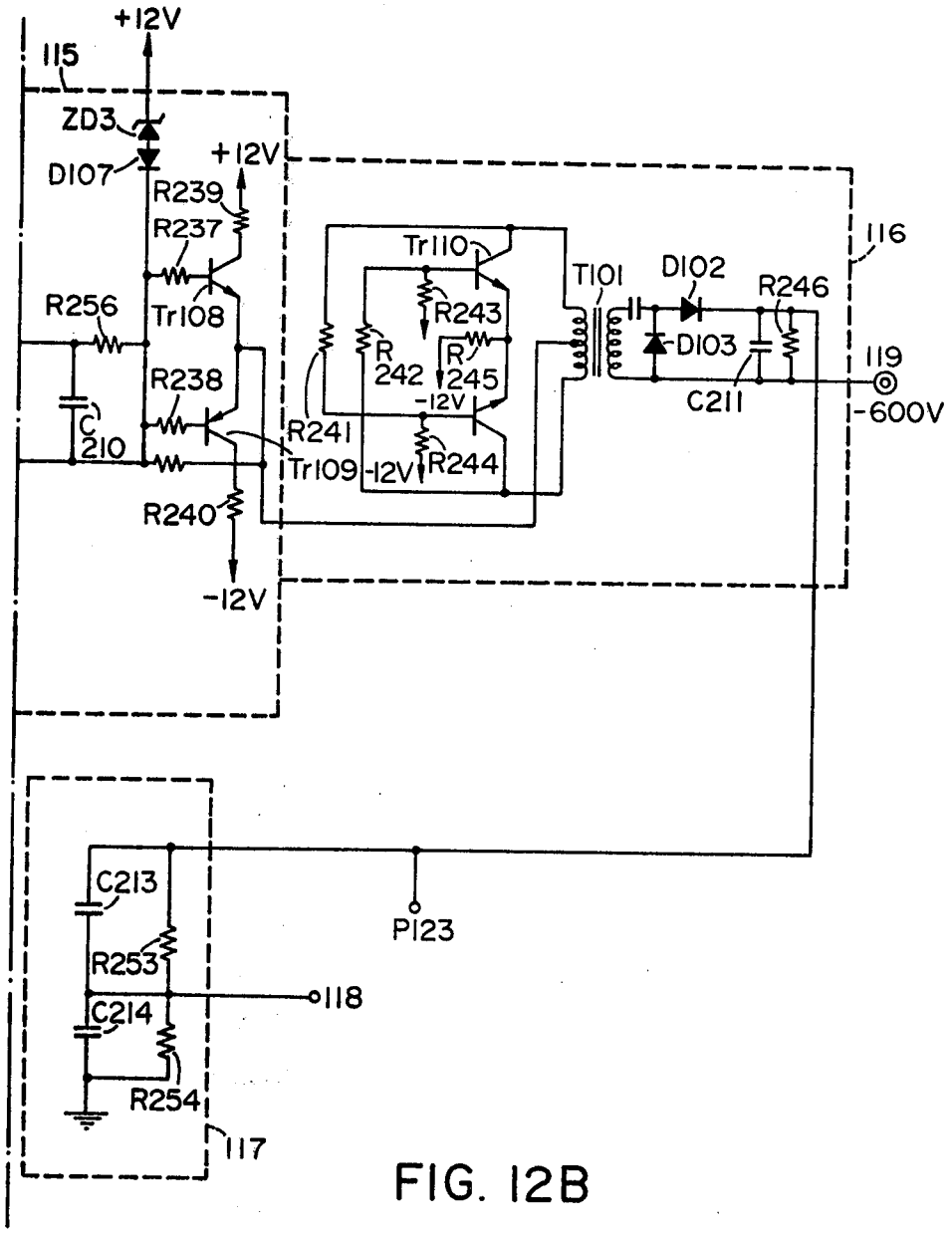

FIGS. 12A and 12B show a detailed circuit diagram of parts other than the parts enclosed by the broken line 100 in FIG. 9.

Output from photocoupler 104 is applied to the terminal P119 and then connected to capacitor C207 after current amplification by an emitter-follower Tr104.

The other terminal of the capacitor C207 is connected to the source follower gate of FETTr 105 and to the drain of FET switch of Tr106. When FET switch of Tr 106 is off, the gate of Tr105 and the drain of Tr106 both get in the state of high impedance. Therefore, the charge stored in C207 cannot escape and the potential on its one terminal at the gate side of Trf105 changes in the same manner as the potential on the other terminal.

Output signal S5 from the photocoupler 110 is differentiated by capacitor C228 and resistor 228. Diode D106 picks up only the positive differentiated waveform component thereof to form the synchronizing signal S6. By pulse output of S6 the transistor Tr107 is made conductive.

With the conduction of transistor Tr107 the light emitting diode LED101 is turned on. LED101 repeats lighting at short pulse intervals only when the vibrator driving circuit and the vibrator are in normal operation. Therefore, the operator can detect any abnormality occurring in the vibrator driving circuit and/or vibrator while watching the LED101. Since the light emitting diode serving as a display element is connected in series with the transmission path of the synchronizing signal, no particular display circuit for detecting such abnormality is necessary in this embodiment which is an advantage of the present invention. Another advantage of this embodiment is found in that a large current can be obtained using a low voltage owing to the provision of the light emitting diode outside of the circuit part including the driver circuit 105 enclosed with the broken line 100. Since a floating power source is used for the circuit part enclosed with the broken line 100, a large current for display at low voltage is prevented. If a high voltage is applied to the part, then the useful life of elements in the part will be shortened thereby. In addition, for the sake of safety it will be required to provide a protection circuit.

Since the output from the operational amplifier Q105 is limited to the level ranging from 0 to ±5 V by clamping Zener diodes ZD1 and ZD2, the cathode of diode D101 is biased to +12 V to cut off D101 when Tr107 is turned On. Consequently, at this time, the stage between source and drain of Tr106 is in the state of zero bias and the stage between drain and source of Tr106 is conductive. By conduction of Tr106 the feedback loop of Q105 is formed by FET switch Tr106, source follower Tr105 and resistor R221. Therefore, the potential difference between two input terminals of Q105 becomes zero. The source potential of Tr105 becomes 0 V (ground potential) because of high input resistance of Q105. Under this condition, the terminal voltage of C207 at the gate side of Tr105 is biased from 0 V to such potential which is shifted by the voltage between the gate and the source of Tr105.

Upon the end of pulse output timing of output signal S6 at terminal P120, transistor Tr107 is turned off and diode D101 is on. Now, current is turned allowed to flow through resistors R226 and R230. Consequently, an inverse bias is deeply applied to the gate of Tr106 so that it is turned off.

Since Tr106 is blocked, as previously described, the terminal voltage of capacitor C207 at the gate side of Tr105 changes in the same manner as the terminal voltage at the other side does.

Figure 10:
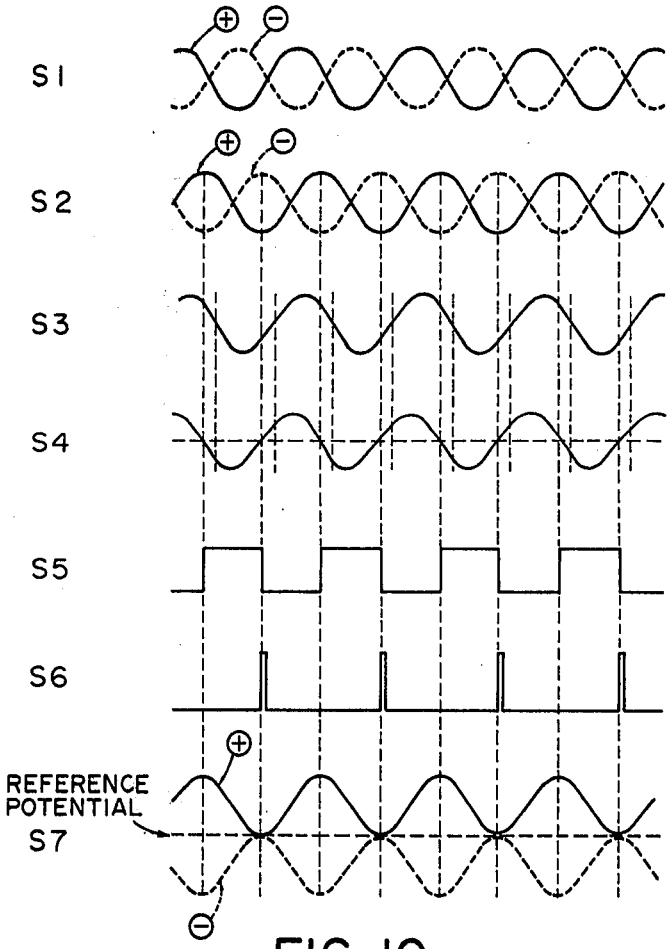
FIG. 10 shows waveforms of signals at the respective parts of the circuit shown in FIG. 9.

In FIG. 10, the signal S2 is the measuring signal applied to the terminal P119. The solid line curve shows the waveform of S2 for the case wherein the measuring potential is positive relative to the chopper potential whereas the broken line curve is for the case wherein the measuring potential is negative relative to the chopper potential.

As shown at S7 in FIG. 10, the output from the clamp circuit has the same waveform as the signal S2 since the negative peak is clamped at 0 V (ground potential) when the measuring potential is positive relative to the chopper potential.

When the measuring potential is negative relative to the chopper potential, the positive peak is clamped at 0 V. Therefore, in this case, the output signal S7 also has the same waveform as the signal S2 (see the broken line curve of S7).

The output S7 is integrated by resistor R231 and capacitor C208 in the integrator 114 and then introduced into the inverter driving circuit 115.

Output from the integrator 114 is put into the operational amplifier Q107 which amplifies it by a voltage difference from a DC potential selected by a volume VR103 as later described. The amplified output is applied to a common terminal at the primary side of inverter transformer T101 through buffer transistors Tr108 and Tr109.

The above-mentioned volume VR103 is a volume for correcting offset voltage. DC potential applied to the negative input terminal of Q107 is made almost 0 V (ground potential) by it.

Inverter transformer T101, transistor Tr110 and transistor Tr111 constitute an inverter which increases about 100 times the input voltage to the primary side of transformer T101. After step-multiplicative rectification of it by diodes D102 and D103, a DC high voltage output in the range of 0–1.5 KV can be taken from both ends of condenser C211 and resistor R246. Since the terminal at the low voltage side of T101 is connected to an output terminal of −600 V obtained from a power source circuit (not shown), a variable output in the range of −300 V to +900 V is obtainable at the cathode of D102.

The output boosted by transformer T101, namely feedback voltage VF is fed back to the chopper part 83 and casing 81 from the terminal P123 through a terminal P52 shown in FIG. 11. Therefore, the measured part and the electrometer form together a negative feedback control system which functions in such manner as to reduce the potential difference of input to the operational amplifier Q107 to zero. More particularly, it makes the potential on the chopper 83 and the casing 81 equal to the measured voltage so that the input voltage to the positive input terminal of Q107 and that to the negative input terminal become equal to each other.

As long as the measured potential Vp is in the range of −300 V to +900 V, the output voltage from the inverter 116, namely the feedback voltage VF, becomes equal to the measured potential Vp.

Output from DC-DC inverter 116 is reduced up to 1/301 by the voltage divider 117 and then taken up from the output terminal P124. The detection output from P124 is transmitted to a control circuit not shown and then used to control the output voltages of primary charger 51 and AC discharger 69 or the bias voltage for development etc.

The feedback voltage VF appearing at the terminal P123 is applied to the chopper 83 and casing 81 and changes so as to bring the potential difference between VF and Vp to zero. Therefore, the output taken up from the terminal P123 is a stable output and is never affected by offset and error of the respective circuits existing in the line extending from pre-amplifier 101 to inverter 116.

Figure 13:
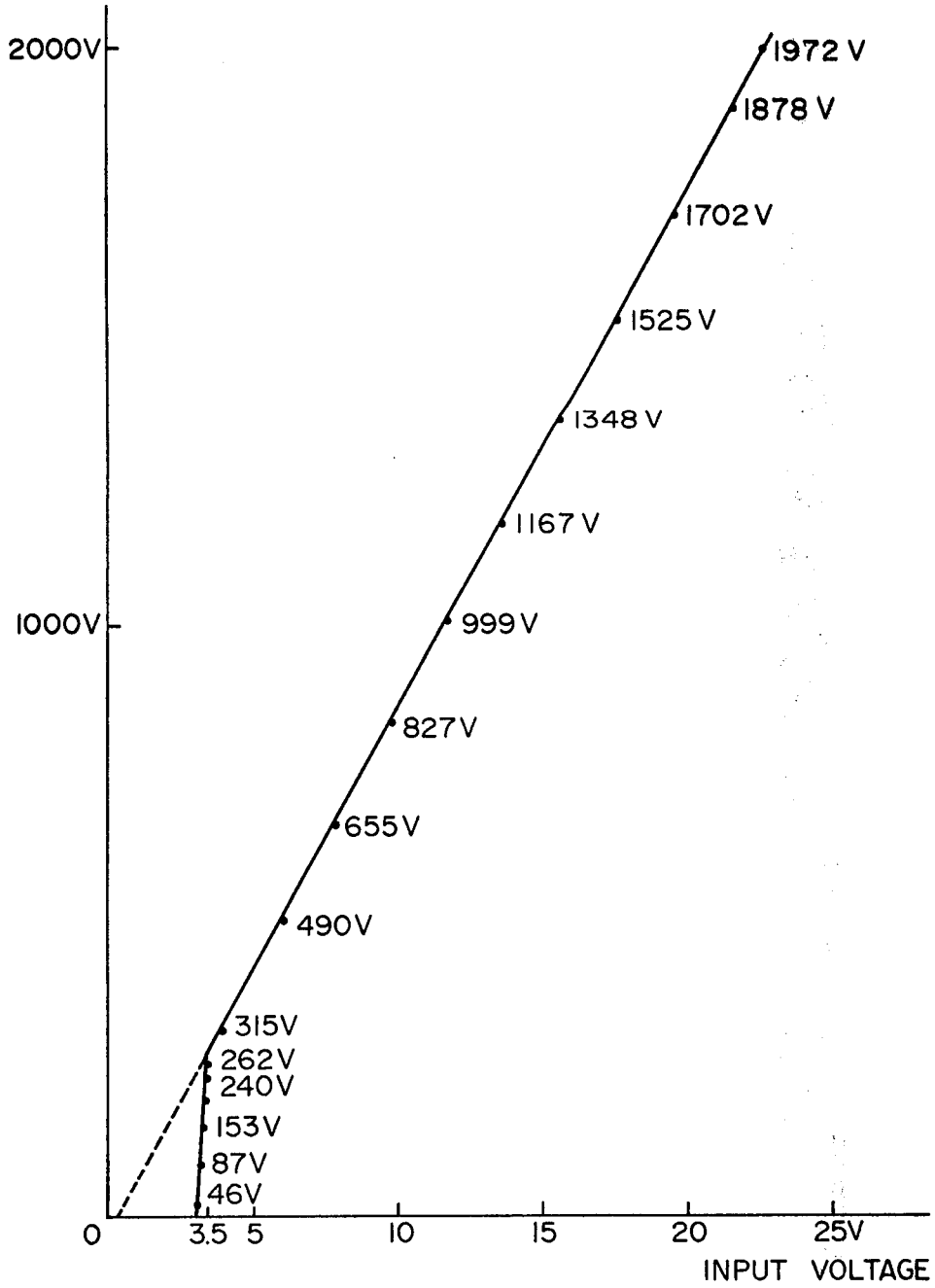
FIG. 13 is an input/output characteristic curve of the DC-DC inverter.

As previously mentioned, DC-DC inverter 116 has some problems. When the input voltage to the inverter 116, namely the voltage between the terminals of capacitor C216 is gradually lowered, the oscillation generated by transistors Tr110 and Tr111 and inverter transformer T101 becomes unstable and will stop. As seen from the input/output characteristic curve shown in FIG. 13, if the input voltage lowers to a level less than 3.5 V under such condition, then the output from the inverter drops abruptly and therefore the gain is increased. If feedback is applied at this time as its operation point, then the feedback control system becomes unstable in operation and the circuit responds badly. In the worst case, it begins to oscillate.

To solve the above problem, according to the shown embodiment of the invention, there is provided a limiter circuit comprising a diode D107 and a Zener diode ZD3. When the output voltage from the operational amplifier Q107 is about to decreases to a certain determined voltage level, the Zener diode ZD3 and diode D106 are made conductive through resistor R256 to keep the cathode voltage of diode D8 at said determined voltage level. Since said predetermined voltage determines the base potential of Tr108 and Tr109, their emitter output, namely the input voltage to DC-DC inverter never decreases to the voltage level at which the amplification gain of the inverter abruptly increases, that is, the voltage level at which the inverter will stop oscillating.

In this manner, the limiter circuit limits the input voltage to the amplifier such as DC-DC inverter. This arrangement prevents loop breaking in the negative feedback loop.

While in the shown embodiment there has been used a turning fork type vibrator as the chopper, it should be understood that another type chopper such as a rotary blade type chopper or rotary cage type chopper also may be used in the invention. Also, while DC-DC inverter has been particularly shown as an amplifier, the present invention is also applicable to all of those amplifier circuits which have an unstable range.

The principle of surface potential control system is described hereunder.

In the example described hereinafter, there is used not the original illumination lamp 46 in FIG. 1, but the blank exposure lamp 70 to detect the surface potentials on the bright and dark portions of the drum. The surface potential on the portion of the drum which was illuminated by the above described blank exposure lamp 70 is measured as bright portion surface potential and the surface potential on the portion of drum not illuminated by the lamp 70 is measured as dark portion surface potential.

To attain a proper picture image contrast, at first, target values are preset for bright portion potential and dark portion potential. In this example, the set target value for bright portion potential VL0 is −102 V and that for dark portion potential VD0 is +474 V. Also, in this example the surface potentials are controlled by controlling the current flowing to the primary charger and AC discharger. For this purpose, it is assumed that when the positive charger has a reference current $DC_1$ and AC discharger has a reference current $AC_1$, the measured bright portion potential and dark portion potential can attain the above-mentioned target values VLo and VDo respectively.

In this example, $DC_1 = 350\ \mu A$ and $AC_1 = 160\ \mu A$.

Procedures of control in this example are as follows:

First, surface potentials VL1 and VD1 detected on the bright portion and dark portion of the drum are compared with the set target values VL0 and VD0, respectively, to know voltage differences ΔVL1 and ΔVD1, wherein $$\Delta VL1 = VL0 - VL1 \quad (1)$$

$$\Delta VD1 = VD0 - VD1 \quad (2)$$

Although correction of the difference for bright portion potential is carried out by AC discharger and for dark by the primary charger, in practice the control on AC charger has an effect to change not only the bright portion potential but also the dark portion potential. Similarly, when the primary charger is controlled, not only the dark portion potential but also the bright portion potential are affected thereby at the same time. For this reason, we employed the following correction method, taking into account both the AC charger and primary charger:

Current correction values ΔDC1 for primary charger is represented by:

$$\Delta DC1 = \alpha_1 \cdot \Delta VD1 + \alpha_2 \cdot \Delta VL1 \quad (3)$$

wherein, set coefficients $\alpha_1$ and $\alpha_2$ are changes in current value of the primary charger with the changes of surface potentials VD and VL, namely:

$$\alpha_1 = \frac{\Delta DC \text{ (change in current of primary charger)}}{\Delta VD \text{ (change of dark portion potential)}} \quad (4)$$

$$\alpha_2 = \frac{\Delta DC \text{ (change in current of primary charger)}}{\Delta VL \text{ (change of bright portion potential)}} \quad (5)$$

On the other hand, current correction value ΔACl for AC charger is represented by:

$$\Delta AC1 = \beta_1 \cdot \Delta VD1 + \beta_2 \cdot \Delta VL1 \quad (6)$$

wherein, $$\beta_1 = \frac{\Delta AC \text{ (change in current of } AC \text{ charger)}}{\Delta VD \text{ (change of dark portion potential)}} \quad (7)$$

$$\beta_2 = \frac{\Delta AC \text{ (change in current of } AC \text{ charger)}}{\Delta VL \text{ (change of bright portion potential)}} \quad (8)$$

Therefore, from the above equations (4), (5) and (1), the primary charger current after first time correction, AC2 are represented by:

$$DC_2 = \alpha_1 \cdot \Delta VD1 + \alpha_2 \cdot \Delta VL1 + DC1 \quad (9)$$

$$AC_2 = \beta_1 \cdot \Delta VD1 + \beta_2 \cdot \Delta VL1 + AC1 \quad (10)$$

In the above, set coefficients $\alpha_1$, $\alpha_2$, $\beta_1$ and $\beta_2$ are determined depending upon some determined conditions such as atmospheric temperature, humidity, state of corona chargers etc. Since the atmospheric conditions and the degree of deterioration change case by case, it is uncertain that the surface potentials can reach the target values by only one control. Therefore, under a given condition, measurement of the surface potentials is carried out several times and also control of corona dischargers are carried out the same number of times as the measurement.

Since desirable coefficients $\alpha_1$, $\alpha_2$, $\beta_1$ and $\beta_2$ can be found out considering the possible irregularity of the photosensitive drum and the like, in this example every coefficient can be selected from among each of four values. The second and following corrections are carried out in the same manner as in the first correction described above. Therefore, the primary charger current value after the n-th correction, DC(n+1) and the AC charger current value after the n-th correction, AC(n+1) can be represented by the following general formulas:

$$DC(n+1) = \alpha_1 \cdot \Delta VDn + \alpha_2 \cdot \Delta VLn + DCn$$

$$AC(n+1) = \beta_1 \cdot \Delta VDn + \beta_2 \cdot \Delta VLn + DCn$$

Figure 14A:
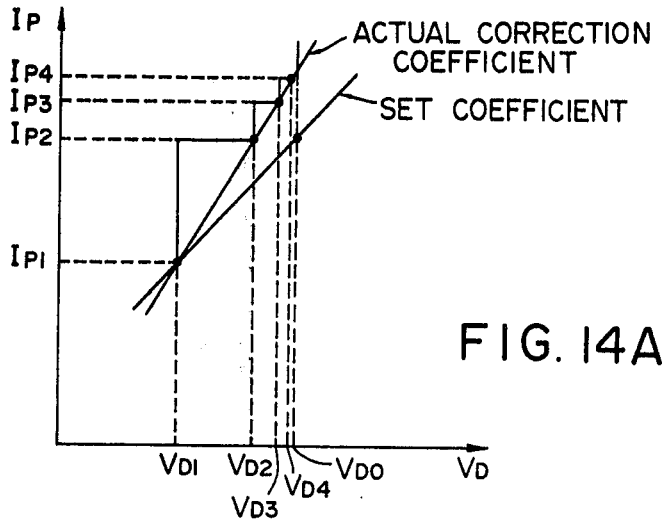
FIGS. 14A and 14B show changes of surface potentials on the dark portion.
Figure 14B:
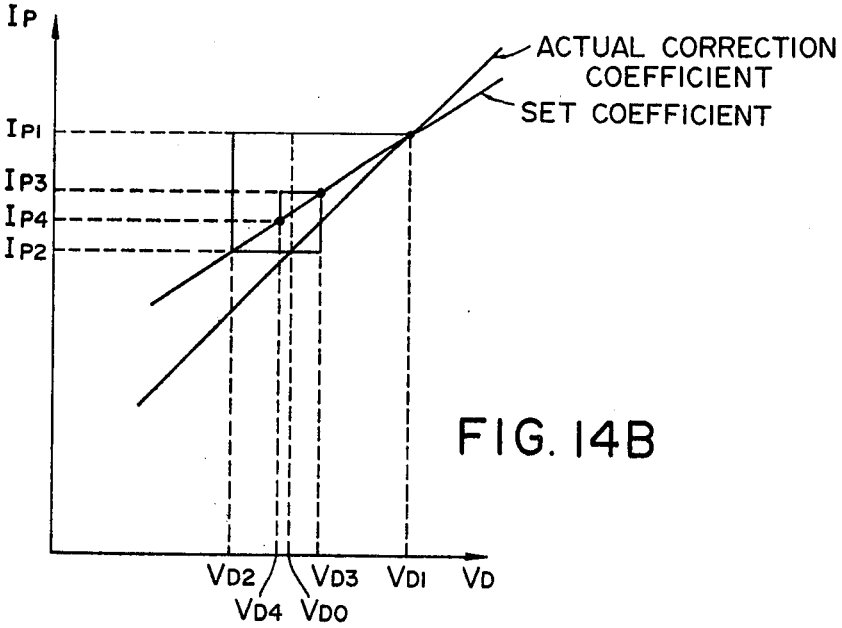

FIGS. 14A and B show changes of dark portion potential when primary charger control current Ip was corrected three times. FIG. 14A shows the case wherein the set coefficient was smaller than the actual correction coefficient whereas FIG. 14B shows the case wherein the former was larger than the latter.

In the example, the number of corrections to be made is determined as shown in the following table:

| State | Contents | Number of corrections |
|---|---|---|
| 1 | Copy start key is pushed within 30 seconds after the end of the previous copying. | 0 |
| 2 | Copy start key is pushed within 30 sec. -½ hr. after the end of the previous copying. | 1 |
| 3 | Copy start key is pushed within ½-5 hrs. after the end of the previous copying. | 2 |
| 4 | Copy start key is pushed after the lapse of time longer than 5 hrs. after the end of the previous copying or pushed after pushing the main key. | 4 |

By setting the number of corrections to be made in this manner, a further stabilization of surface potential on the photosensitive medium can be attained with the minimum speed-down of copying operation.

In the case of State 1, the control output current values of the primary charger and AC charger used in the previous copying operation have been stored in memory to use the stored values directly for controlling the chargers at this time.

In the case of State 2, the control output current previously used is applied to the photosensitive medium to detect the potentials on the surface and then control the chargers using the detected value.

However, in the cases of States 3 and 4, the previously used control current values are not used but reset to return the control values to the reference current values DC1 and AC1. For the first correction at the present time, measurement of the surface potentials is carried out with the reference values DC1 and AC1. According to the result of the measurement for correction, the output currents are controlled. Also, in the case wherein copying has been carried out continuously for 30 min. without an interruption time longer than 30 sec., one correction has to be carried out after the continuous operation for 30 min.

In this example, control on the development bias voltage is also carried out in accordance with the invention. The manner of control of development bias voltage is described hereinafter with reference to FIGS. 15A and 15B.

Figure 15A:
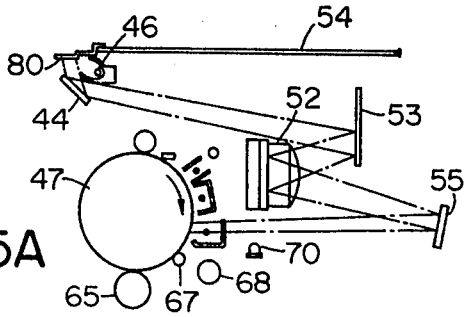
FIG. 15A is a schematic section view of the copying machine regarding developing bias control.

In FIG. 15A, reference numeral 80 designates a standard white plate mounted on one side of the glass plate of the original table 54. The standard white plate 80 is illuminated by a halogen lamp 46 and the scatter-reflected light from the standard white plate is directed to the drum 47 through the mirrors 44, 53 and 55 and lens 52. The quantity of the reflected light to which the drum surface is exposed is a reference light value. Thereafter, the original illumination lamp 81 is moved to illuminate an original on the original table. The quantity of light to which the original is actually exposed at this time is an actual exposure value which has been optionally set by the operator.

The surface potential measuring meter 67 measures the surface potential on the portion of the drum 47 irradiated with the above said scatter-reflected light. The measured surface potential is referred to as $v_L$. By adding +102 V to the measured value $v_L$ there is determined a development bias voltage VH.

Since the bias voltage VH is applied to toner, the potential on the toner is nearly equal to the bias voltage. For example, when the standard bright portion potential, namely the measured value $v_L$ is −150 V, the potential on the toner is −48 V. Therefore, toner and drum repel each other and the toner cannot adhere to the drum. This prevents fogging on the background portion of the original and assures good performance of development. Thus, stable and high quality picture images can be obtained.

The standard white plate 80 corresponds to the white portion of a common original. According to the embodiment, the white standard plate is exposed with the standard light value and for actual exposure of original the standard value is changed over to the exposure value optionally set at that time by the operator. Therefore, in even such case wherein the original has a colored background rather than white, highly and stable quality picture images can be obtained by changing the bright portion surface potential on the drum using the most suitable exposure value.

Figure 15B:
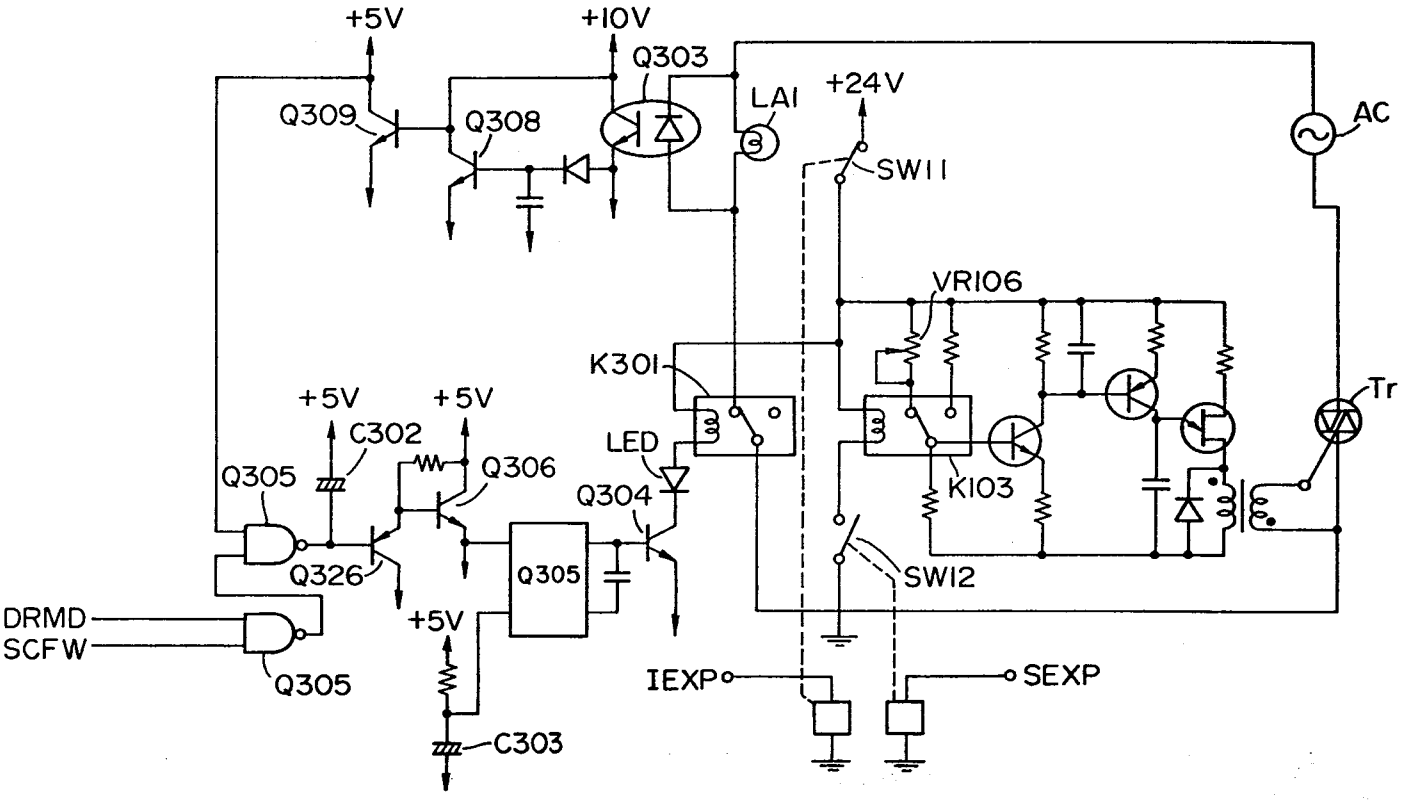
FIG. 15B shows a circuit for switching the original exposure lamp and controlling the light thereof.
Figure 16A:
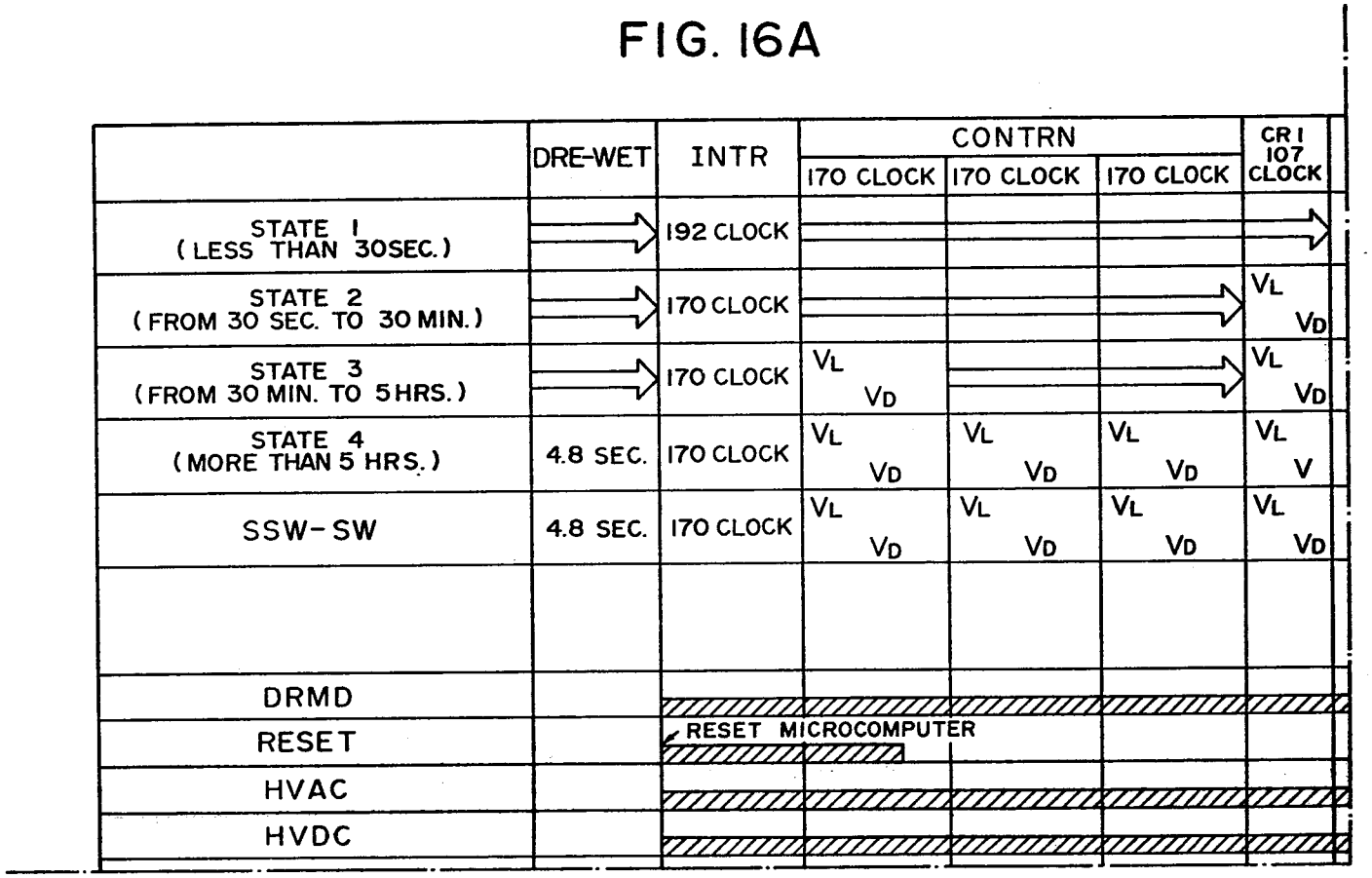
FIGS. 16A to 16D show a timing chart for imaging formation and surface potential control in combination as shown in FIG. 16.
Figure 16B:
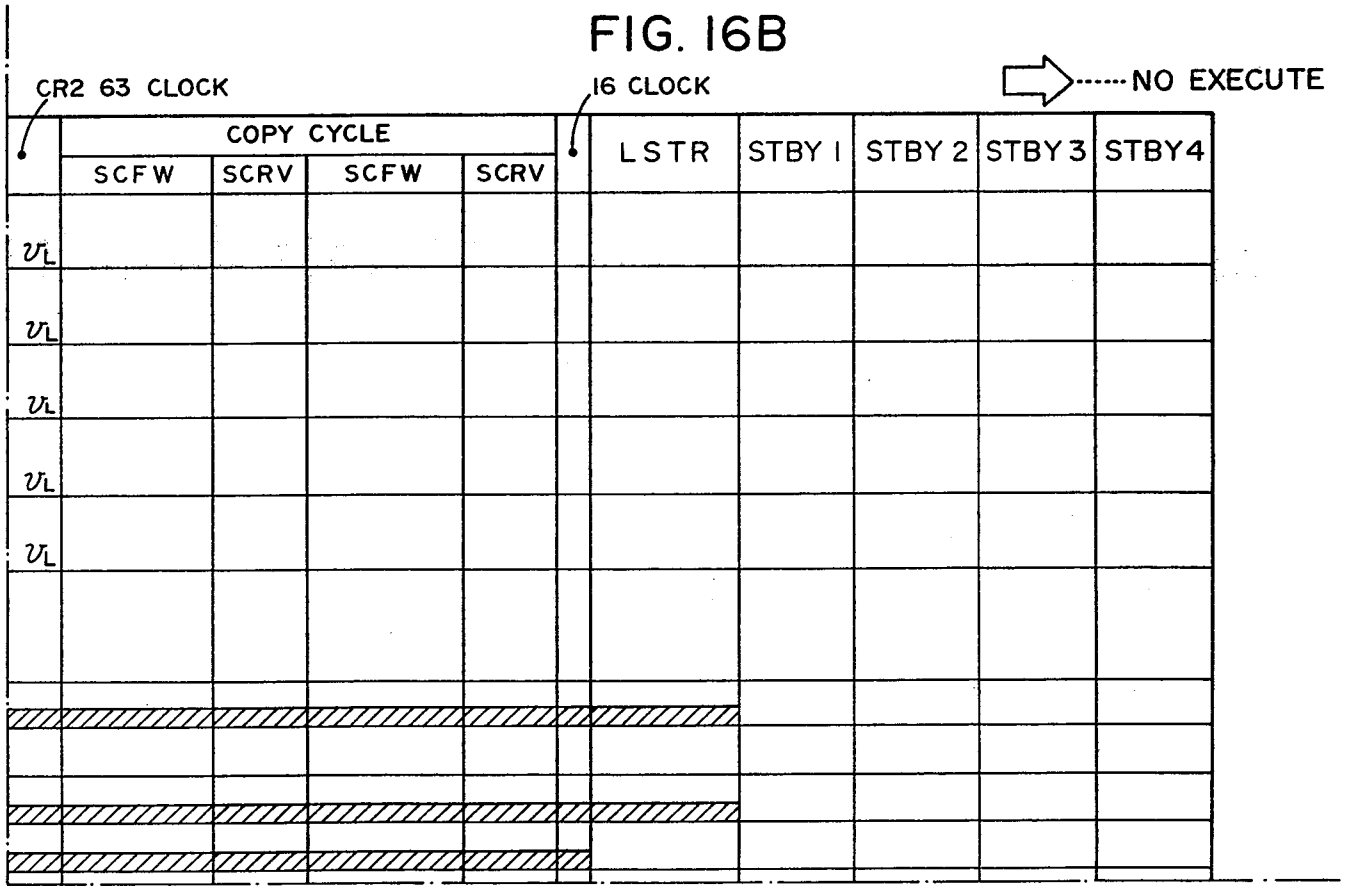
Figure 16C:
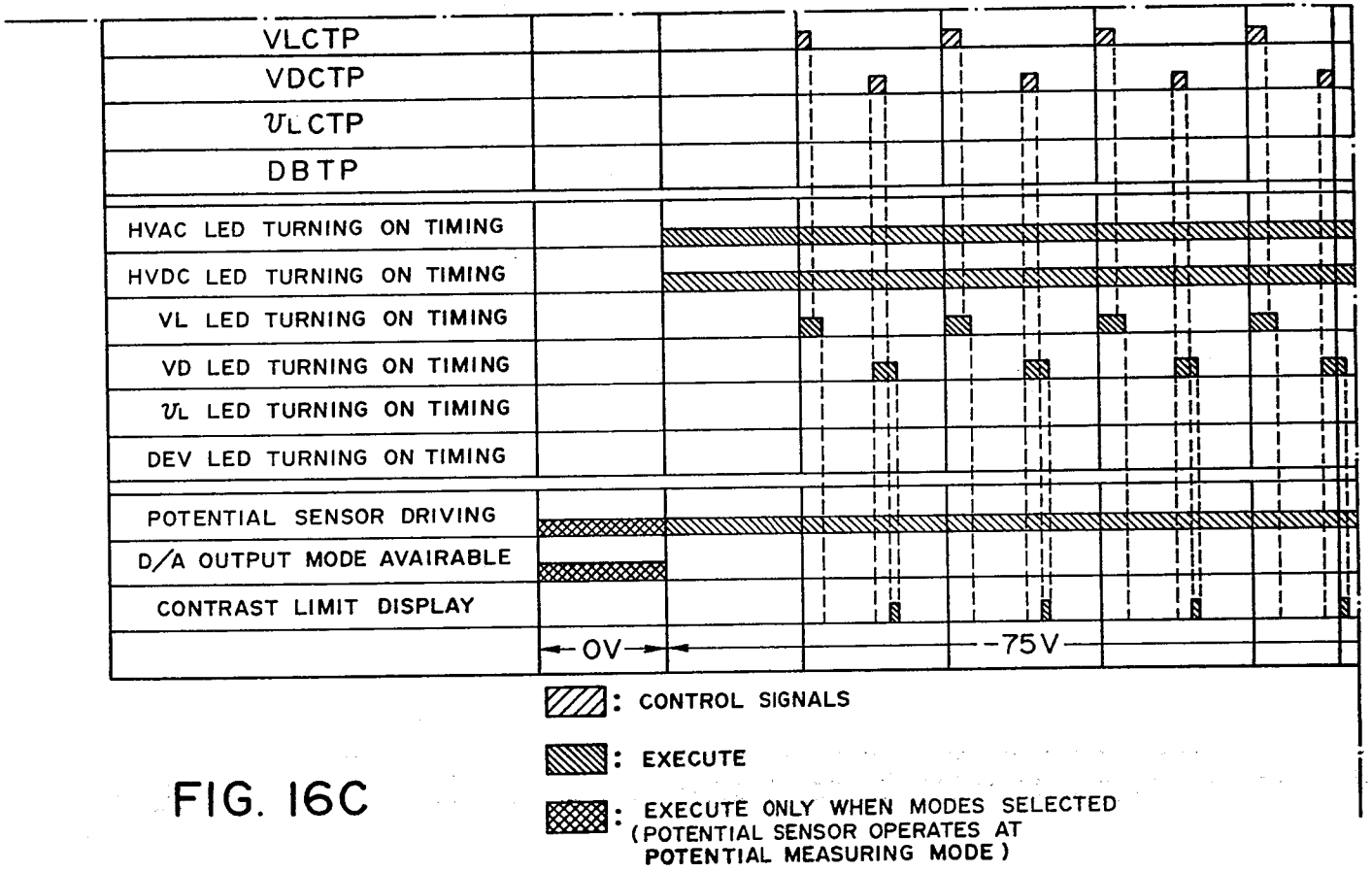
Figure 16D:
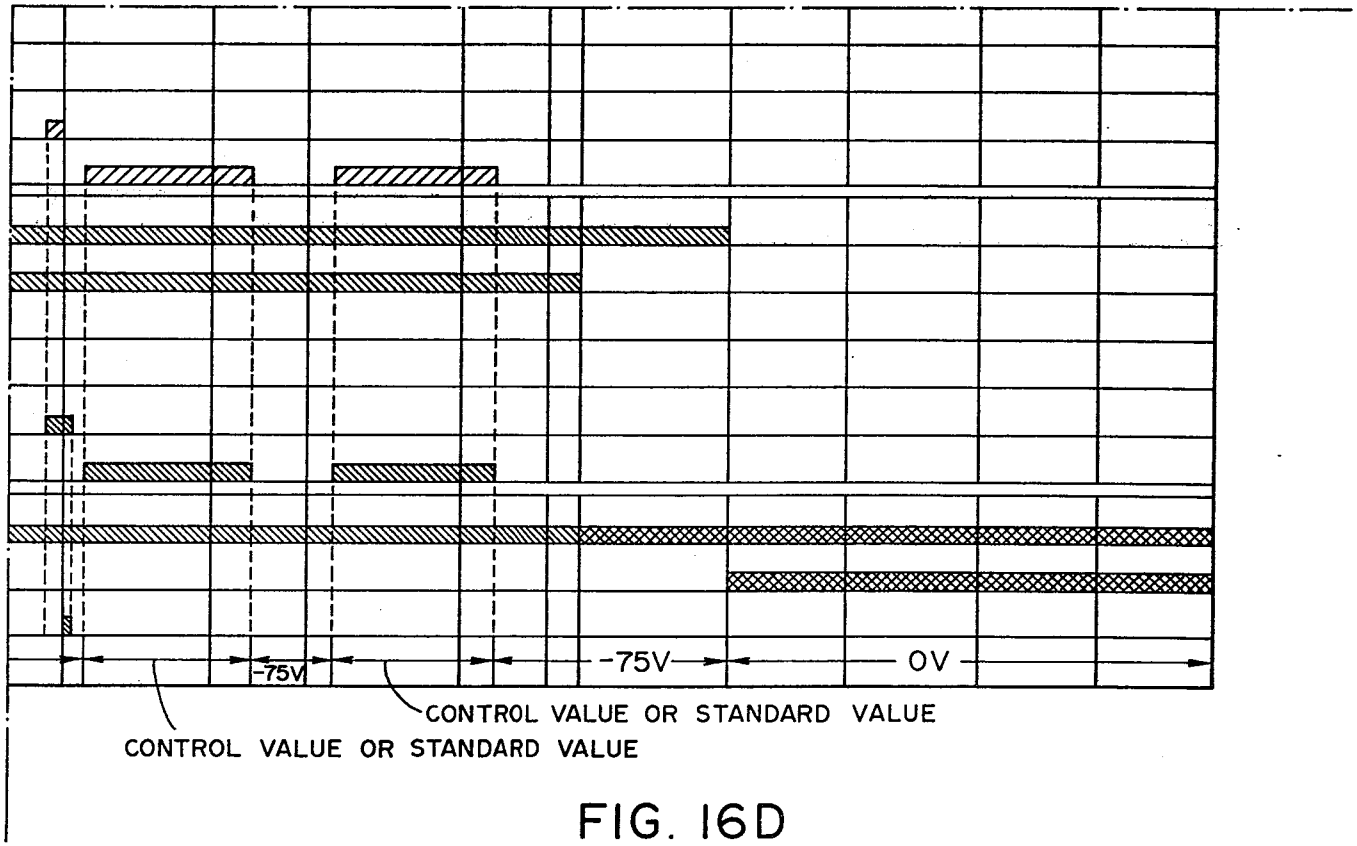
Figure 17A:
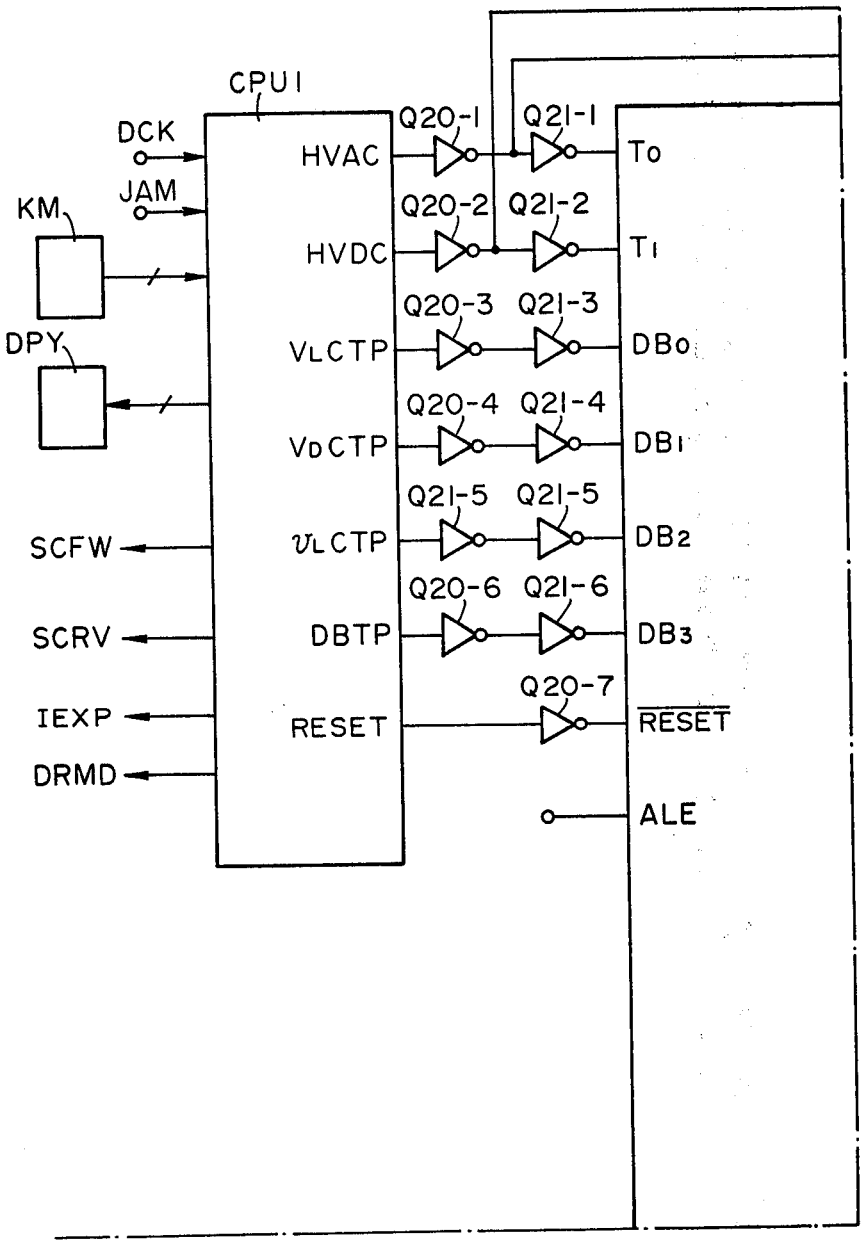
FIGS. 17A to 17H show a circuit diagram of the potential control unit in combination as shown in FIG. 17.
Figure 17B:
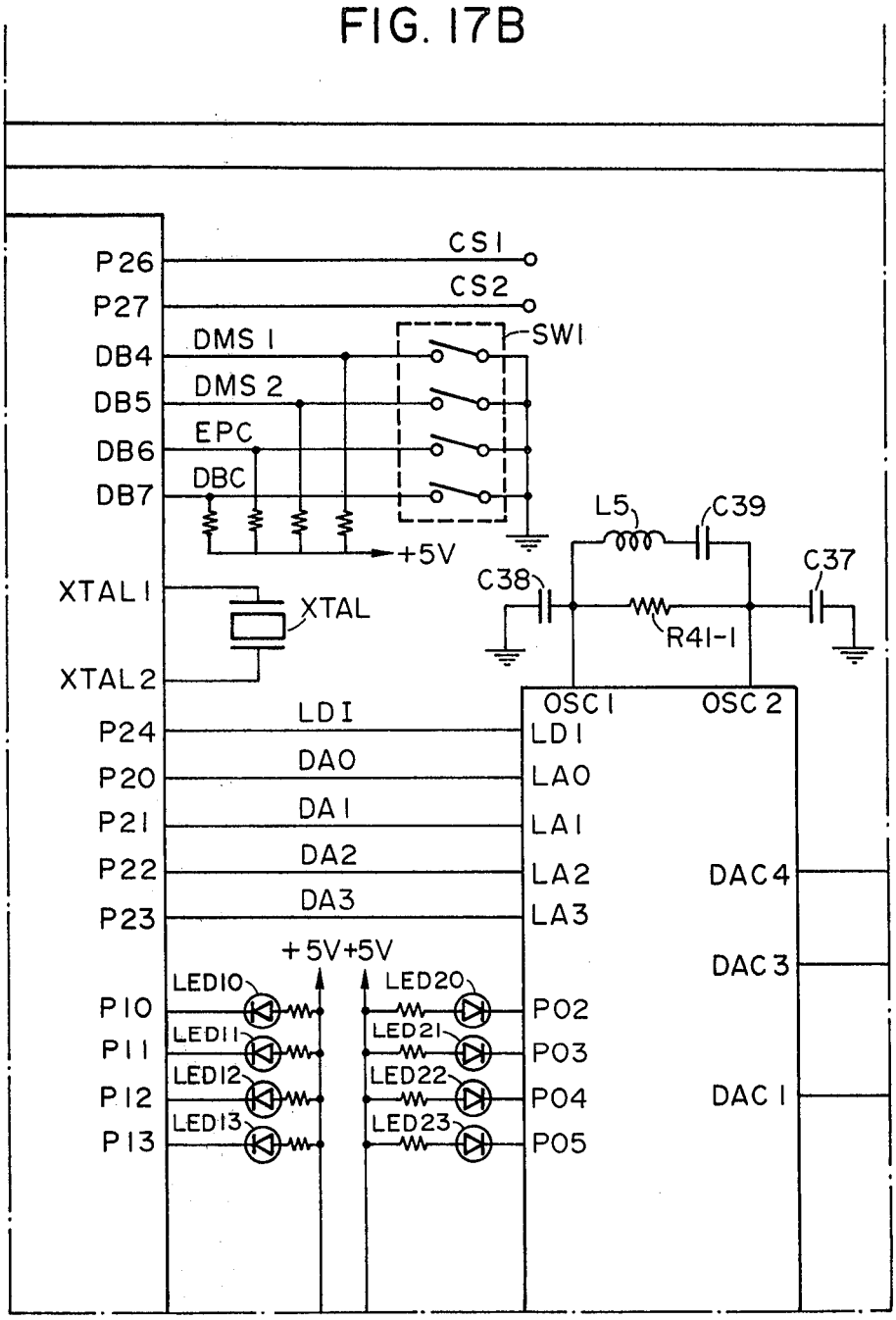
Figure 17C:
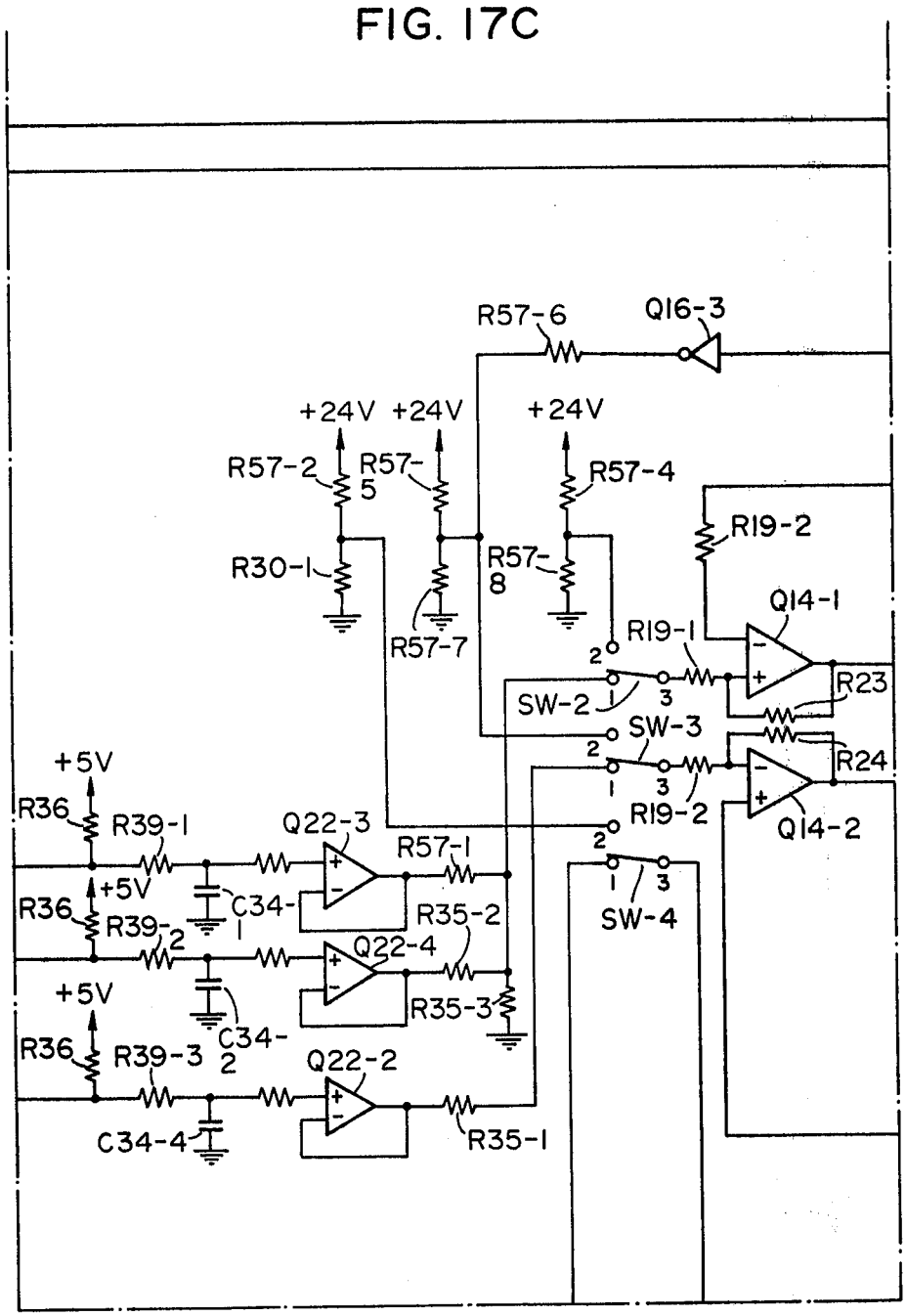
Figure 17D:
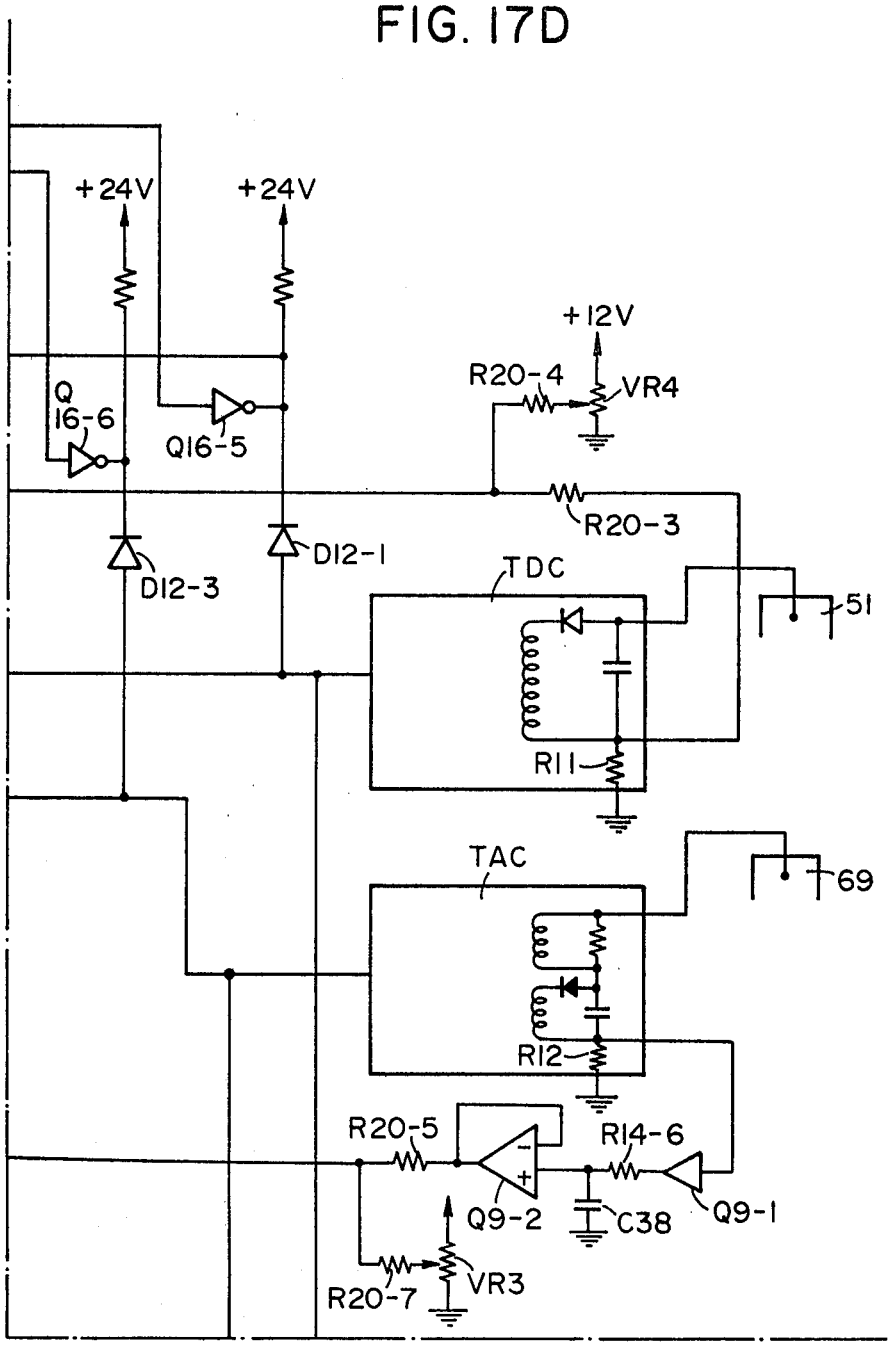
Figure 17E:
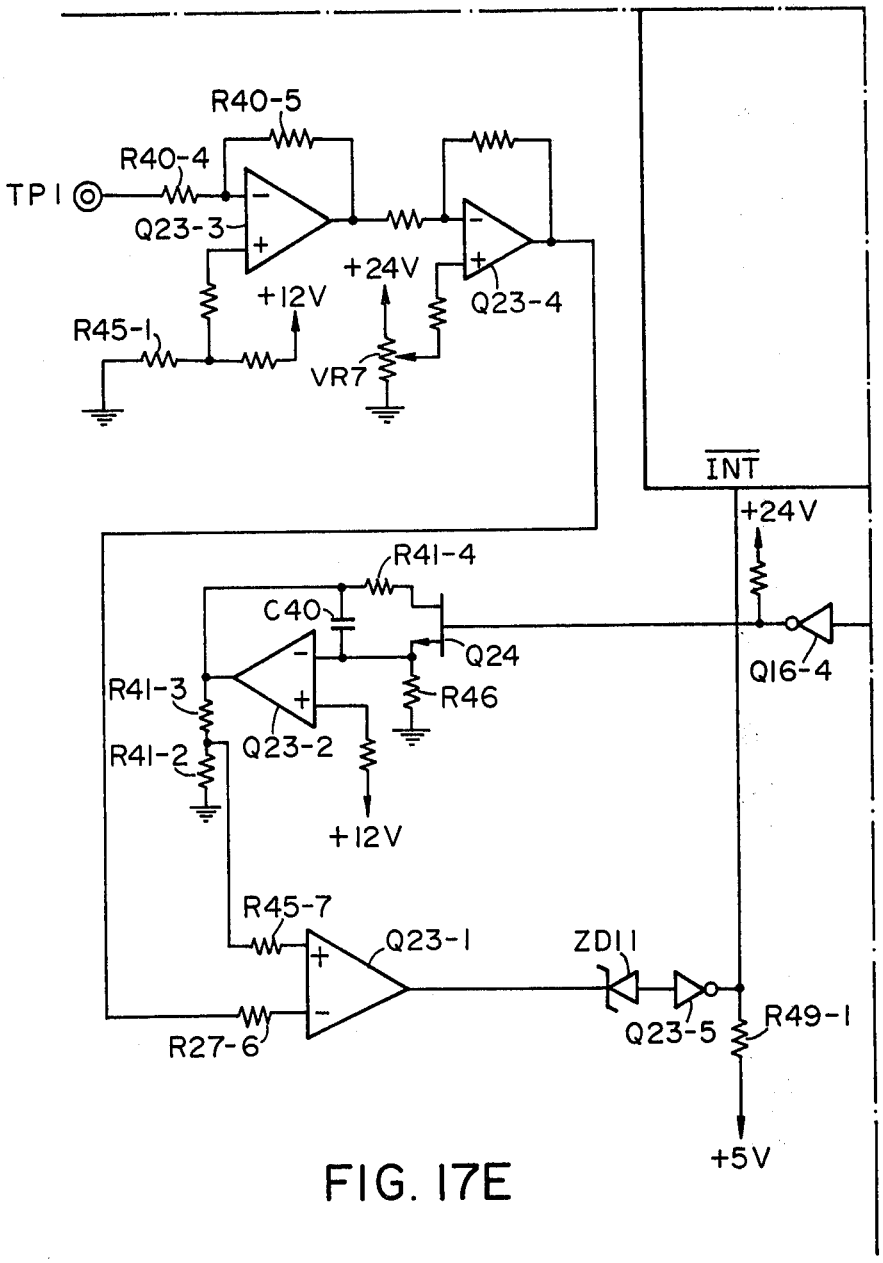
Figure 17F:
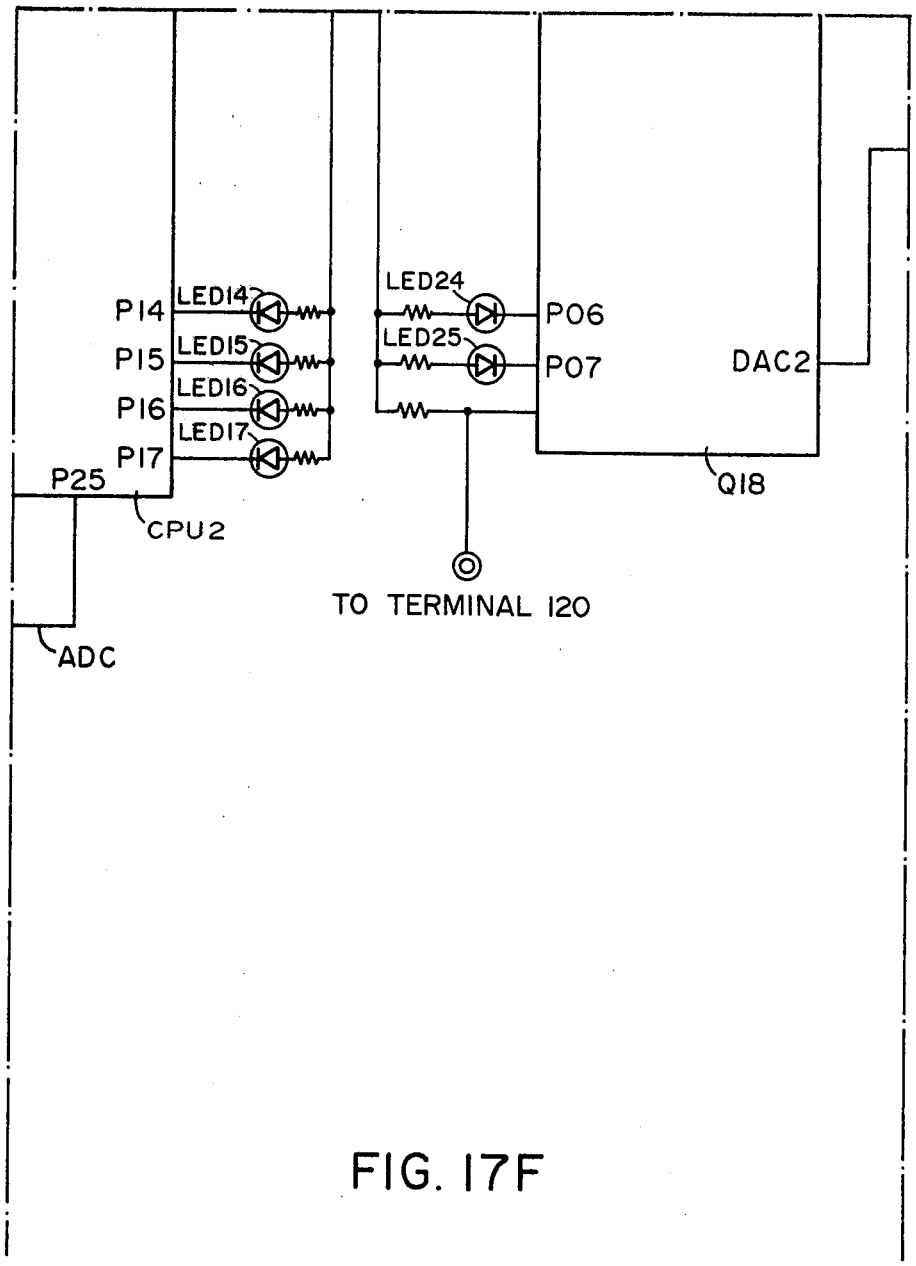
Figure 17G:
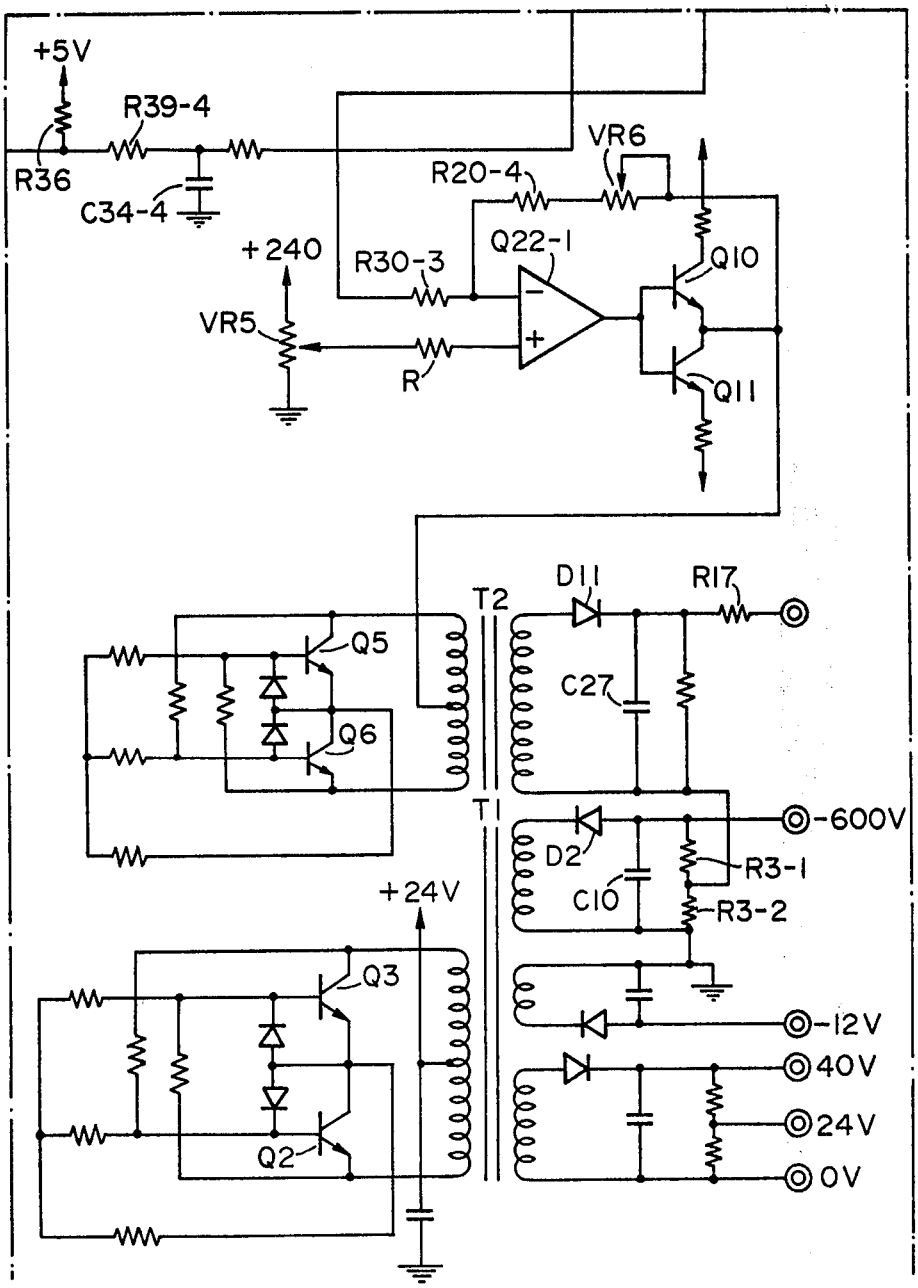
Figure 17H:
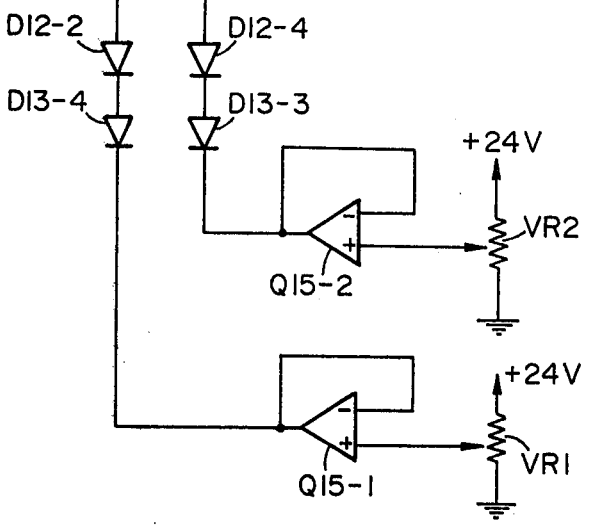

FIG. 15B shows a form of lighting and dimming circuit for regulating the light value of the original exposure lamp 46.

In FIG. 15B, reference character K301 designates a relay which is normally in the position shown in the drawing. In case of abnormality, the relay cuts off the current flowing to the lamp LA1. By one signal of timing output IEXP issued by a DC controller not shown, switch SW11 is turned on to actuate a triak Tr which turns the lamp on. This timing is shown in the timing chart in FIG. 16.

In the present embodiment, the density of copy is controlled by changing the light value of the lamp LA1. For this purpose, the apparatus comprises a dimmer circuit which controls the light value by phase controlling the flow of current according to the displacement of density regulating means VR106 through triak.

In the shown position, the relay K103 makes the resistor VR106 regulate the light value. When the relay is in the position opposite to the shown position, it controls the lamp at the standard light value which is the same as the value given by bringing a density regulating lever on the operating part not shown into the middle position. Switch SW12 is turned on by means of a standard light value signal SEXP to expose the standard white plate to light with the standard light value. Then, the bright portion potential $v_L$ on the drum is measured and a suitable bias voltage VH is determined according to the measured value.

In this manner, the development bias voltage VH is determined while exposing the standard white plate 80 to the light emitted from the original exposure lamp which is actually used to expose the original. Therefore, accuracy of control on the development bias voltage is further improved. In addition, since this exposure for determining the bias voltage VH is carried out immediately before actual exposure of the original, no reduction of copying speed is caused thereby. Furthermore, since the exposure value is changed over to an exposure value optionally set by the operator when the original is actually exposed to light, stable and high quality images can be obtained without any problem of fogging even when the background of the original is colored rather than white.

FIGS. 16A to 16D show a timing chart for carrying out the above described image formation and surface potential control.

In FIGS. 16A to 16D, INTR means pre-rotation step of which description has already been made. During this step, any remaining electric charge on the drum is erased and a proper sensitivity is given to the drum. This step must be carried out without exception before every copying operation.

CONTR-N means a rotation of the drum, which is required in order to keep the drum in its normal state. During this step, the bright portion potential VL and dark portion potential VD are measured alternately at every revolution of the drum. Based upon the measured values, the surface potentials are made to approach the target values under the action of a surface potential control circuit as will be described later. Measurement of the surface potentials VD and VL may be carried out several times per one revolution instead of once per revolution.

CR1 is a step of detecting VL and VD during 0.6 revolution of the drum and of controlling the corona chargers.

CR2 is a pre-rotation of the drum immediately before copy start. During this step, the development bias to be applied to the developing roller is determined while measuring the bright portion potential using light of standard light value from the original illuminating lamp. This step is executed without exception at every copy start.

SCFW means a step during which the optical system is moving forward. Namely, it means rotation of the drum for actual copying operation.

LSTR is a post-rotation step of which description has already been made. STBY1–STBY4 mean standing-by positions of the copying machine.

The manner of operation of surface potential control circuit is described hereinafter with reference to FIGS. 17A to 17H showing a form of control circuit used in the copying machine.

In FIGS. 17A to 17H, CPU1 is a microcomputer having a program stored therein. According to the stored program, various outputs are issued from CPU1 to drive and control the respective parts of the copying machine. CPU1 receives drum clock pulse DCK in synchronism with the revolution of drum 47, jam detection signal JAM, signal from key matrix KM etc. as inputs. In response to the inputs, it issues various necessary output signals such as drum rotating signal DRMD, original table forwarding signal SCFW, original table returning signal SCRV, original exposure lamp driving signal IEXP, primary charger driving signal HVDC, AC discharger driving signal HVAC and output to display DPY.

In addition, it issues a signal for controlling another microcomputer CPU2 provided for controlling potential.

Primary charger driving signal HVDC, AC discharger driving signal HVAC, bright portion potential detection timing pulse VLCTP, dark portion potential detection timing pulse VDCTP, standard bright portion potential $\nu_L$CTP and developing device driving signal DBTP from the sequence control microcomputer CPU1 are introduced into inputs terminals T0 and T1 and data busses DB0–DB3 of the potential control microcomputer CPU2 through inverter buffers Q20 and Q21. Also, initial reset pulse is put into the terminal $\overline{\text{RESET}}$ of CPU2 through inverter Q20-7.

In response to these timing signals, CPU2 takes in the later described surface potential A/D conversion data and carries out determined arithmetic operation processing. The results of arithmetic operation are put out from CPU to D/A converter as primary charger current control value, secondary charger current control value and development bias control value. By turning a mode changeover switch SW1, it is also possible to make CPU issue such values as to supply reference currents to the primary and secondary chargers and also to set the development bias to 0 V.

The surface potential measured by the surface potential meter and potential measuring circuit shown in FIG. 12 is put into the terminal TP1. Further, the surface potential is put into the inversion input terminal of operational amplifier Q23-3 through resistor R40-4 and there it is inverse amplified at a gain determined by the ratio of resistance R40-4 to resistor 40-5. To the non-inversion input terminal of Q23-3 is applied a bias of +6 V obtained by division by resistors R45-1 and R45-2 to carry out a level shift. Output from Q23-3 is applied to inversion buffer of the gain 1 by operational amplifier Q23-4. Voltage applied to non-inversion input terminal of Q23-4 is variable using a variable resistor VR7 for adjustment of levels of measured potential. Output from Q23-4 is introduced into A/D converting part as a low impendance signal which changes in the range of from 12 V to 17 V in proportion to the change of surface potential. The A/D converting part comprises operational amplifiers Q23-1, Q23-2 etc. A/D command signal ADC from CPU2 is normally "H" and the output from inverter Q16-4 is "L". Therefore, FET switch Q24 has zero bias at its source-gate stage and is conductive at its source-drain stage so that output from Q23-2 is kept at +12 V.

CPU2 detects rising of timing pulses VLCTP, VDCTP and $\nu_L$CTP given by CPU1 and tuns A/D command signal ADC from "H" to "L" which is then introduced into inverter Q16-4. At this time, output from Q16-4 becomes "H" and an inverse bias is applied to the gate of FETQ24 to block Q24. When Q24 is blocked, the output from Q23-2 and capacitor C40 and resistor R46 form together an integrating circuit loop because of +12 V being applied to the non-inversion input terminal of Q23-2. Consequently, the output from Q23-2 makes the capacitor 40 charged linearly with the current flowing through R46 starting from 12 V as initial voltage until A/D command signal becomes "H" and thereby FETQ24 is made conductive. When FETQ24 is made conductive, charge stored in C4 is discharged through R41-4 and therefore the output from Q23-2 abruptly drops to 12 V. A certain determined time after the start of the above integration by A/D command, counting is started within CPU2. To make the time of this counting start coincident with the minimum value 12 V of output from Q23-4, the output from Q23-2 is level shifted by resistors R41-2 and R41-3 and then introduced to the non-inversion input terminal of the comparator constituting operational amplifiers Q23-1 through R45-7. To the inversion input terminal is applied the above mentioned measured potential through R27-6. So long as the output voltage from the integrating circuit is lower than the measured potential, the output from Q23-1 continues to be "L" and CPU2 continues counting. At the point where the two voltages become equal, the output from Q23-1 is turned to "H" and this level change is, as a counting end pulse, put into the interruption terminal $\overline{\text{INT}}$ of CPU2 through Zener diode ZD11 and inverter Q23-5. CPU2 processes the count value counted therein until the end of counting as the above mentioned measured potential A/D converting value. In this manner, bright portion potential, dark portion potential and standard bright portion potential can be A/D converted in synchronism with timing pulses VLCTP, VCDTP and $\nu_L$CTP, respectively.

In this embodiment, there has been used as CPU2 a NMOS 1-chip 8-bit microcomputer (Model: μPD8048C by NIHON DENKI Co., Ltd.). Names of terminals of CPU and signals put in or put out from the terminals are listed in the following table:

TABLE 1

| name of terminal | pin No. | input/output | | |
|---|---|---|---|---|
| TO | 1 | input | HVAC | |
| XTAL1 | 2 | | crystal terminal for clock | |
| XTAL2 | 3 | | | |
| $\overline{\text{RESET}}$ | 4 | input | reset | |
| $\overline{\text{SS}}$ | 5 | | connected to +5 | |
| $\overline{\text{INT}}$ | 6 | input | CEP count ending pulse | |
| EA | 7 | | connected to GND | |
| $\overline{\text{RD}}$ | 8 | | no use | |
| $\overline{\text{DSEN}}$ | 9 | | | |
| $\overline{\text{WR}}$ | 10 | | | |
| ALE | 11 | output | check of clock oscillation | |
| DB0 | 12 | input | VLCTP | |
| DB1 | 13 | input | VOCTP | |
| DB2 | 14 | input | $\nu$LCTP | |
| DB3 | 15 | input | DBTP | |
| DB4 | 16 | input | DMS1: display mode select 1 | |
| DB5 | 17 | input | DMS2: display mode select 2 | |
| DB6 | 18 | input | EPC: control exists at potential control select 0 | |
| DB7 | 19 | input | DBC: control exists at development bias control select 0 | |
| $V_{SS}$ | 20 | input | GND grounding terminal | |
| P20 | 21 | output | DA0 | D/A converter Q18 transfer output |
| P21 | 22 | output | DA1 | |
| P22 | 23 | output | DA2 | |
| P23 | 24 | output | DA3 | |
| PROG | 25 | | | |
| $V_{DD}$ | 26 | | +5V source terminal | |
| P10 | 27 | output | high voltage secondary current upper limit LED10 | LSB |
| P11 | 28 | output | high voltage secondary current lower limit LED11 | LED for potential display |
| P12 | 29 | output | high voltage primary current upper limit LED12 | |
| P13 | 30 | output | high voltage primary current lower limit LED13 | |
| P14 | 31 | output | contrast 1 LED14 | |
| P15 | 32 | output | contrast 2 LED15 | |
| P16 | 33 | output | for display LED 16,17 | |
| P17 | 34 | output | | MSB |
| P24 | 35 | output | LDI | |
| P25 | 36 | output | ADC | |
| P26 | 37 | input | CS1 | |
| P27 | 38 | input | CS2 | |
| T1 | 39 | input | HVDC | |

TABLE 1-continued

| name of terminal | pin No. | input/ output | |
|---|---|---|---|
| $V_{CC}$ | 40 | | +5V source terminal |

To terminals DB4–DB7 are applied signals DMS1 and 2, EPC and DBC from changeover switch SW1 respectively.

Control modes of CPU2 in the respective conditions of these signals are shown in the following table:

TABLE 2

| SWI | | | | | | | |
|---|---|---|---|---|---|---|---|
| DMS1 | DMS2 | EPC | DBC | high voltage primary and secondary output value | development bias output value | display content of LED10–LED17 | mode |
| 0 | 0 | 0 | 0 | control value | control value | contrast limit | regular mode |
| 0 | 0 | 0 | 1 | control value | standard value | contrast limit | regular mode |
| 0 | 0 | 1 | 0 | standard value | control value | contrast | regular mode |
| 0 | 0 | 1 | 1 | standard value | standard value | surface potential | potential display mode |
| 0 | 1 | 0 | 0 | control value | control value | VL potential | potential display mode |
| 0 | 1 | 0 | 1 | control value | standard value | VL potential | potential display mode |
| 0 | 1 | 1 | 0 | standard value | control value | VL potential | potential display mode |
| 0 | 1 | 1 | 1 | standard value | standard value | surface potential | potential measuring mode |
| 1 | 0 | 0 | 0 | control value | control value | VD potential | potential display mode |
| 1 | 0 | 0 | 1 | control value | standard value | VD potential | potential display mode |
| 1 | 0 | 1 | 0 | standard value | control value | VD potential | potential display mode |
| 1 | 0 | 1 | 1 | standard value | standard value | surface potential | potential measuring mode |
| 1 | 1 | 0 | 0 | control value | control value | νL potential | potential display mode |
| 1 | 1 | 0 | 1 | control value | standard value | νL potential | potential display mode |
| 1 | 1 | 1 | 0 | standard value | control value | νL potential | potential display mode |
| 1 | 1 | 1 | 1 | standard value | standard value | surface potential | potential measuring mode |

D/A converting part is described hereunder.

D/A converter Q18 is connected to CPU2 by four data lines DA0–DA3 and one control line LDI. When LDI increases, CPU2 appoints, through DA0–DAC, primary charger current control data, AC charger current control data or development bias control data for data to be A/D converted. When LDI decreases, D/A converter Q18 latches therein data on DA0–DA3 sent out from CPU2. The converter Q18 carries out D/A conversion by detecting the coincidence of the latched data with 4-bit, 6-bit, 12-bit binary counter counted by an internal clock. The clock oscillates by capacitors C37, C38, C39 and resistor R41-1 and coil L5. In other words, in this D/A conversion, the analog values are obtained by integrating pulses which are obtained according to data and changes in duty.

At D/A outputs DAC 3 and DAC 4 there are obtained pulses of 4 bit resolution. At output DAC 1 is obtained a pulse of 12 bit resolution and at DAC 2 is obtained pulse of 6 bit resolution. These pulses are converted into analog voltages by the integrating circuit formed of resistor R39 and capacitor C34. Since the output is of open drain, a pull-up resistor R36 is provided.

The D/A converted primary charger current control value appears as voltage values corresponding to upper 4 bits at DAC4 and to lower 4 bits at DAC3. After passing through non-inverse buffers of operational amplifiers Q22-3 and Q22-4, these two voltage values are added together by resistors R57-1, R35-2 and R35-3 to form a voltage value corresponding to 8 bits, which is then applied to the No. 1 terminal of changeover switch SW2.

Secondary charger current control value is converted into a voltage value corresponding to 12 bits and put out from DAC1. The voltage value is applied to No. 1 terminal of changeover switch SW3 passing through non-inverse buffer of operational amplifier Q22-2.

Development bias control value is applied to the No. 1 terminal of SW4 after integration.

Changeover switches SW2, SW3 and SW4 are provided for changeover between potential control by CPU2 and operation by another circuit. The latter mentioned circuit makes the reference current flow into the chargers and also makes the development bias a predetermined value without passing through CPU2. By this changeover, even when CPU2 gets inoperative for any trouble, it is possible to supply the reference current to chargers and apply a determined bias to developing roller.

As for the primary charger 51, resistance dividing by R57-4 and R57-8 makes a voltage which will give the primary charger 51 the reference current. This voltage is applied to No. 2 terminal of changeover switch SW-2. As for the secondary charger 69, to change over the current between AC and weak AC, inverter Q16-3 is turned on and off by means of signal HVAC. When the signal HVAC is "H", output of Q16-3 becomes "L". Thus, a voltage determined by R57-4, R57-6 and R57-7 is applied to No. 2 terminal of SW-3. This voltage is set to such level which will give the secondary charger 69 the reference current. When HVAC is "L", Q16-3 is turned off. In this position, R57-4 and R57-7 determines a voltage which gives the secondary charger the weak AC.

For development bias, as in the case of the primary charger, a voltage is obtained by resistance dividing by R57-2 and R30-1 which is applied to the No. 2 terminal of changeover switch SW-4 as the development bias reference voltage.

As described above, if any trouble occurs in any circuit at the upstream side of D/A converter, changeover means SW2–SW4 prevents the trouble from extending to the high voltage chargers and development bias circuit at the downstream side of the converter. Furthermore, said changeover means assures that even in the case of emergency the high voltage chargers can put out a determined reference current and the development bias circuit can put out a determined reference voltage. Thus, even if a problem occurs in any circuit at the upstream side of D/A converter, the apparatus can continue forming images without a marked degradation of image quality.

Primary charger control voltage Vcp is applied to the inversion input terminal of operational amplifier Q14-1 through resistor R19-1 after passing through the terminals 1 and 3 of SW-2. The voltage difference between said control voltage Vcp and the feedback voltage $V_{FP}$ applied to the non-inversion input terminal of Q14-1 is put out from Q14-1 after being multiplied by $$-\frac{R23}{R19\text{-}1}.$$

When primary charger driving signal HVDC is "L", output from Q20-2 becomes "H" whereas output from Q16-5 becomes "L" so that a forward bias is applied to diode D12-1. Therefore, the diode becomes conductive and the output from Q14-1 is clamped at 0.6 V. As a result, the primary charger is turned off. When the driving signal HVDC is "H", primary high voltage transformer TDC receives output from Q14-1. The voltage given to TDC is increased toward the secondary side according to the turn ratio of the transformer. Then, the voltage is rectified and smoothed by diode and capacitor, and it is applied to the primary charger 51. The primary corona current Ip flowing through the primary charger 51 is detected by resistor R11 and level shifted by a combination of R20-4, VR4 and R20-3. Then, the corona current Ip is put into the non-inversion terminal of Q14-1 through R19-2. Thus, the primary corona current Ip is controlled to attain the coincidence of said control voltage Vcp and feedback voltage $V_{FP}$.

Similarly, AC discharger control voltage VAC is applied to the inversion input terminal of Q14-2 through R19-4. To the non-inversion terminal of Q14-2 is applied feedback voltage VFAC. The voltage difference between said feedback voltage VFAC and control voltage VAC is multiplied by $$-\frac{R24}{R19\text{-}4}$$

and then put out from Q14-2. When Ac discharger driving signal HVAC is "L", output from Q20-7 is "H" and that from Q16-6 is "L". Therefore, diode D12-3 becomes conductive and the output from Q14-2 is clamped at 0.6 V. As a result, AC discharger is turned off.

When HVAC becomes "H", output voltage from Q14-2 is applied to AC high voltage transformer TAC. The voltage is increased toward the secondary side according to the turn ratio of the transformer, and it is rectified and smoothed by diode and capacitor to form a DC output. The AC high voltage transformer TAC also puts out an AC high voltage on which the above DC output is superposed. The superposed output voltage is applied to the secondary charger 69. AC corona current IAC flowing through the charger 69 is detected by resistor R12. The detected output is amplified by amplifier Q9-1 and integrated by R14-6 and C38. After buffering by Q9-2, the output is level shifted by R20-5, R20-7 and VR3 and then applied to the non-inversion input terminal of Q14-2 to control the AC corona current IAC in such manner as to attain the coincidence between feedback voltage VFAC and control voltage VAC.

In this manner, diodes D12-1 and D12-2 block the high voltage chargers 51 and 69. This is required for the following reason:

As seen from the timing chart shown in FIG. 16, during the time of step PRE-WET the digital computer CPU2 remains unreset and therefore its output is indefinite. Such indefinite output may have an adverse effect on image formation. High voltage corona may be caused by indefinite control voltage during the period of PRE-WET. To prevent such trouble, during this period, outputs of the chargers 51 and 69 are blocked by means of signals HVDC and HVAC.

Q15-2 is a buffer circuit the output of which is a value given by dividing 24 V by variable resistor VR2. Operational amplifier Q14-1 is an inverter whose high voltage output current increases with a decrease of the primary charger control voltage Vcp. If the control voltage Vcp is about to decrease to a level lower than its minimum value, then the output from Q14-1 increases to its maximum value and therefore the input to the primary high voltage transformer TDC increases up to its maximum value. To limit the output level from Q14-1, the above said output from Q15-2 is set to a level about 1.2 V lower than the maximum output of Q14-1 by using VR2. By doing so, overshoot of the output of Q14-1 can be effectively prevented. When the output is about to exceed the maximum value, diodes D12-4 and D13-3 become conductive and therefore the output of Q14-1 cannot increase beyond the maximum value. The same may be said of the limiter for AC discharger.

Furthermore, for primary high voltage transformer TDC and AC high voltage transformer TAC there are provided breakers which stop outputs from the high voltage transformers TDC and TAC when inputs to these high voltage transformers reach a predetermined value.

Figure 18:
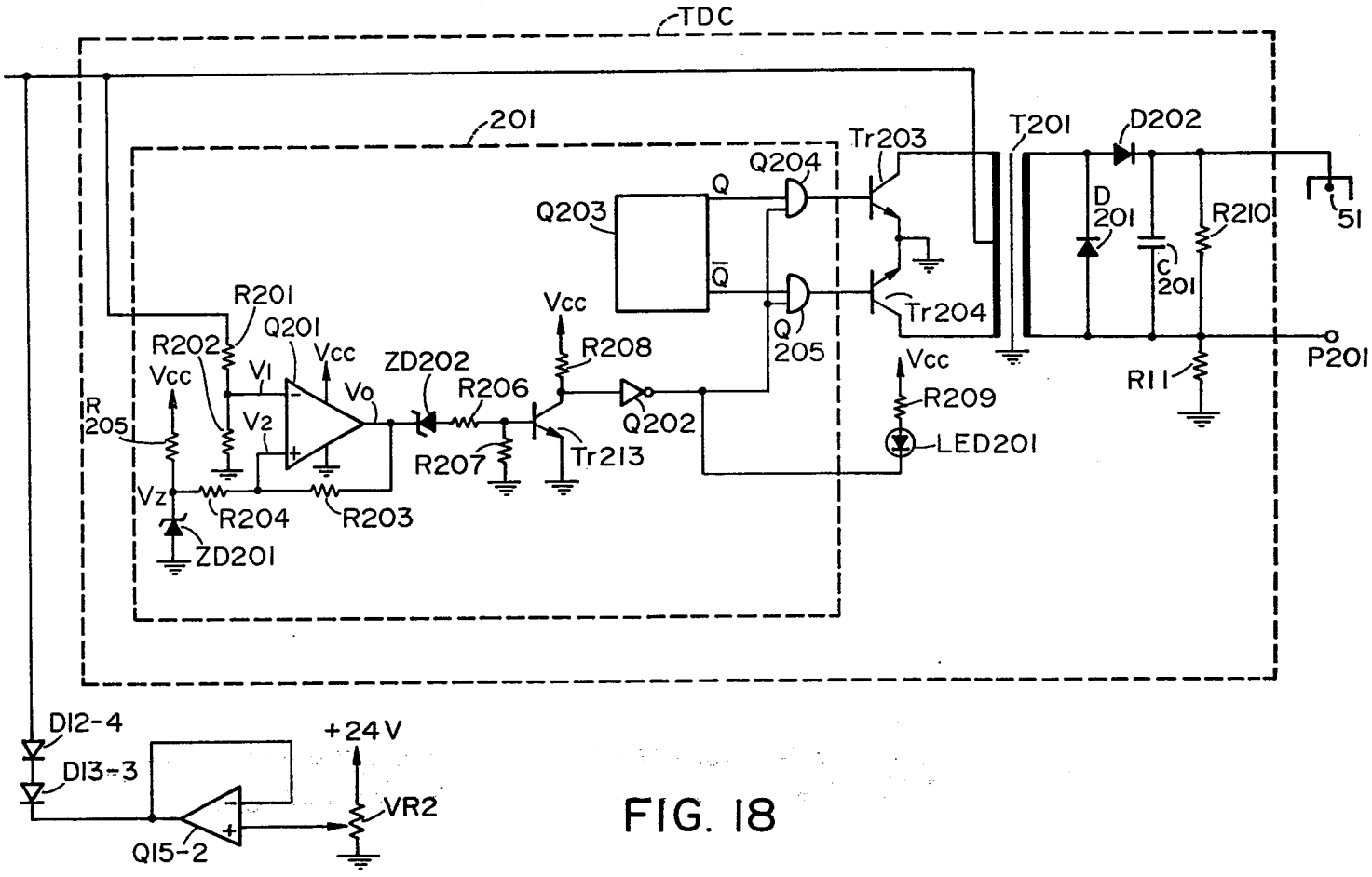
FIG. 18 is a detailed circuit diagram of the high voltage transformer of a primary charger.

FIG. 18 shows a concrete form of circuit of the high voltage transformer TDC for primary charger 51.

Output from operational amplifier Q14-1 is introduced into the primary side of transformer T201. Designated by 201 is an oscillator including a breaker circuit. The oscillator 201 turns on transistors Tr203 and Tr204 alternately. The high voltage output from T201 is step-multiply rectified by diodes D201, D202 and condenser C201 and then applied to the primary charger 51. R11 is a sampling resistor for detecting the primary charger current. The detected output is introduced into the non-inversion input terminal of operational amplifier Q14-1 from terminal P201.

Input voltage to the high voltage transformer is applied also to the oscillation circuit 201 including a breaker. This input voltage is voltage divided by resistors R201 and R202 and then applied to the inversion input terminal of comparator Q201. This voltage is referred as V1. To the non-inversion input terminal of Q201 is applied a composite voltage V2 resulting from the feedback voltage of Q201 output through R204 and a determined voltage $V_z$ by Zener diode ZD201. As long as the output from Q14-1 operates normally, $V1<V2$. Under this condition, the comparator Q201 is on. Let V0 denote the output from the comparator Q201 at the time. Then, V2 is:

$$V2_u = \frac{V2 \times R204 + Vo \times R203}{R203 + R204}$$

Therefore, transistor Tr213 is on and output from inverter Q202 is "H". Gates Q204 and Q205 are open and the transformer is oscillating at this time.

When the position is turned to $V_1>V_{2u}$, Q201 turns off. V0 is about 0 V and V2 becomes:

$$V_{2L} = V_2 \times \frac{R203}{R203 + R204}$$

When the comparator Q201 is off, transistor Tr213 is off and the output of inverter Q202 becomes "L". AND-gates Q204 and Q205 connected to oscillator Q203 are closed and therefore the transformer T201 stops oscillating. Thus, the breaker is brought into operation. At this time, light emitting diode LED201 turns on to make the operator notice the actuation of the breaker. After once turned off, the comparator Q201 continues to be off irrespective of drop of $V_1$ so long as the latter value is higher than $V_{2L}$. Accordingly, the output from the high voltage transformer continues stopping. To turn the comparator Q201 on, the operator turns off the main switch to cut off power sources such as Vcc and then again connects the power sources in the circuit. From the time of this connection of the power source to the rising-up of $V_1$ up to the determined voltage, $V_1<V_{2L}$. Therefore, the comparator Q201 is turned on. Gates Q204 and Q205 are opened and the transformer T201 again starts oscillating.

If safety means should depend on only the operation of above breaker, the breaker might be very frequently actuated by output of the control circuit for controlling the input to the high voltage transformer and image forming operation should be stopped frequently. According to the embodiment of the invention, however, there is provided a limiter circuit to avoid such trouble. The limiter circuit can operate at a lower voltage (second determined value) than the breaking circuit operating voltage (first determined value). The limiter circuit comprises diodes D12-4 and D13-3 and operational amplifier Q15-2. By providing such limiter circuit in addition to the breaker circuit, the number of times of breaker actuation can be minimized without any afraid fear of the high voltage transformer being damaged and therefore the image forming operation can be carried out in a satisfactory manner. The breaker is actuated only in a serious emergency case such a occurrence of abnormal current flow through the charger which may be caused, for example, by contact of the recording medium surface with the charger or by foreign matters between the recording medium and charger. After the breaker has once been actuated in the case of such emergency, the high voltage transformer remains stopped. It can be restarted only after the operator has cut off once the power source and removed the trouble. In this manner, safety for the apparatus is improved. Provision of the above described limiter circuit also makes it easy to adjust the maximum value of output from the control circuit for controlling the input voltage to the high voltage transformer.

In the above, the safety means has been particularly described in connection with the primary charger 51. However, it should be understood that the same is applicable to the secondary charger 69.

Development bias control signal applied to No. 1 terminal of SW-4 is introduced into operational amplifier D22-1 from No. 3. terminal thereof through resistor R30-3. The operational amplifier amplifies the input control signal with a gain determined by the ratio of R30-1; VR6: R30-3 and then puts out an amplified control signal which is applied to the central point of inverter transformer T2 through a current booster composed of transistors Q10 and Q11. To the non-inversion input terminal of Q22-1 is applied a voltage given by dividing 24 V by a variable resistance VR5. Therefore, the level of development bias is adjustable by adjusting VR5. Also, the gain of development bias is adjustable by variable resistance VR6.

For the step of operation during which the drum is rotating and no development is being carried out, the level of bias voltage is adjusted to −75 V to prevent the developing agent from adhereing onto the drum. For the stand-by period, the bias voltage is adjusted to 0 V to prevent charged liquid developer from settling while the drum is not running.

During development, the development bias is controlled by development bias control signal from D/A converter and the value of development bias is adjusted to +102 relative to the standard bright portion potential. The desired development bias value is obtained, in this embodiment, by a combination of the variable output inverter transformer T2 and fixed output inverter transformer T1. The output generated from the transformer T2 is variable depending upon the output from above mentioned current booster.

The variable output inverter is formed as a self-oscillation inverter. Transistors Q5 and Q6 alternately repeat on and off by which there is induced at the primary side of transformer T2 a voltage according to the development bias control voltage applied to the center of T2. The induced voltage is boosted up to the secondary side voltage which is determined the turn ratio of T2. The boosted voltage is half-wave rectified by diode D11 and smoothed by condenser C27. Thus, a DC high voltage output is obtained which is applied to the developing roller through R17.

The fixed output inverter, on the other hand, obtains a negative fixed DC high voltage. To this end, 24 V is applied to the center of the primary side of T1. A secondary high voltage output according to the turn ratio of the transformer is rectified and smoothed by D2 and C10. The divided voltage from the mid-point of R3-1 and R3-2 is superimposed above said output from the variable output inverter. The development bias voltage changes linearly from positive to negative depending on the input control voltage.

At the fixed output inverter T1, there are obtained, in addition to the fixed output for development bias, also −12 V source voltage, floating source voltages of 24 V and40 V for surface potential measuring circuit, and a source voltage of 31 600 V for the measuring circuit.

If conventional regulators or the like were used to obtain these various power source voltages necessary for control, a large space and a large number of components would be required. In particular, for the floating power source, a very complicated circuit would be required. In contrast, according to the above embodiment of the invention, the necessary various source voltages can be obtained very effectively and in a simplified manner.

The microcomputer CPU2 has a program stored therein to perform the above described surface potential control. FIGS. 19's arranged as in FIG. 19 through E show the flow chart of the stored program wherein DC denotes digital value for controlling the primary charger, AC does control digital value for AC discharger and DB does control digital value for development bias. DCSA, ACSA and DBSA are RAM areas within CPU2 for saving the above digital values DC, AC and DB respectively.

The steps SP1 to SP23 of the flow chart are described hereunder briefly.

SP1

In response to reset signal RESET from CPU1, all RAM areas are cleared and all of input and output ports are set to the positions ready for input and output respectively. Also, initial setting of ACSA, DCSA and DBSA is made. The current flowing to the primary charger and AC discharger is set to 0 μA and development bias voltage to 0 V.

SP2

AC discharger driving signal HVAC informing of copy start is discriminated between "0" and "1". When it is "0", the step is jumped to SP 23 and when "1", it is advanced to the next step SP3.

SP3

Ports of CPU2 are set once more and sensor driving signal is issued. LED24 and LED25 are turned on to indicate that the signals HVAC and HVDC are "1".

SP4

Signal EPC of changeover switch SW1 is examined to determine which value is to be put out to the primary charger and AC discharger, standard value or control value by detection output from the electrometer.

SP5

In accordance with the decision made at the previous step SP4, the reference current or the stored values in areas ACSA and DCSA are applied to the primary charger and AC discharger. Also, an output is issued so as to adjust the development bias to −72 V.

SP6

Signals HVAC, HVDC, $V_L$CTP, $V_D$CTP, $\nu_L$CTP and DBTP are examined and then the step is proceeded to the respective processing steps according to the contents of the signals. At display subroutine, 8 bit display of potential is made on LED10–17 only when potential display mode and potential measuring mode are selected. For the potential measuring mode and potential display mode, the potential selected by the change-over switch SW1 is transferred to an accumulator within CPU2 to display it on LED10–LED17.

SP7

Upon output of bright portion potential detection signal VLCTP, LED is turned on to indicate it. At the same time, a measurement of the bright portion potential $V_L$ is carried out and the result thereof is saved. Then, $V_L-V_{L0}$ is calculated and the result thereof is saved. Subsequently, coefficient $\alpha_2$ is selected from the group consisting of four different values while judging signals CS1 and CS2 applied to the terminals P26 and P27 of CPU2 respectively. After selection of $\alpha_2$, a calculation of $\alpha_2(V_L-V_{L0})$ is executed and the result thereof is saved. Similarly, $\beta_2$ is selected, $\beta_2(V_L-V_{L0})$ is calculated and its result is saved. After completion of the above operations, LED20 is turned off and step is returned back to SP4.

SP8

In response to output of dark portion potential detection signal $V_D$CTP, LED21 puts on to indicate it. The dark portion potential $V_D$ is measured and the result thereof is saved.

SP9

Switch SW1 is checked as to whether potential control exists or not. In case of "no", step is jumped to SP17. In case of "yes", step is advanced to the next step SP10.

SP10

$(V_D-V_{D0})$, $\alpha_1(V_D-V_{D0})$ and $\beta_1(V_D-V_{D0})$ are calculated. The results of calculations $\alpha_1(V_D-V_{D0})$ and $\beta_1$ $(V_D-V_{D0})$ are saved. The coefficients $\alpha_1$ and $\beta_1$ are selected by means of signals CS1 and CS2 in the same manner in the case of $\alpha_2$ and $\beta_2$ described above.

SP11

$\alpha_1(V_D-V_{D0})+\alpha_2(V_L-V_{LD})=\Delta DC'$ is calculated and its result is added to the previously given primary charger control current value DC. Since DC is 8 bit and ΔDC' is 16 bit, (DC×8+ΔDC') is calculated to obtaind DC' (16 bit).

SP12

DC' is checked as to whether it is within the range of control or not. In case of overflow, LED12 is turned on to indicate it and DC' is set to a determined value. In case of underflow, LED13 is turned on to indicate it and DC' is set to a determined value.

SP13

DC' (16 bit) is converted into DC (8 bit) and the latter is saved in DCSA.

SP14

To obtain AC discharger control current value AC' (16 bit), a calculation is executed. At first, $\beta_1(V_D-V_{D0})+\beta_2(V_L-V_{L0})$ is calculated to obtain ΔAC' (16 bit). The previous control current value AC is multiplied by 8 and the product is added to above ΔAC'.

SP15

Judgement is made as to whether AC' is within the range of control. In case of overflow, LED is turned on to indicate it and AC' is set to a determined value. In case of underflow, LED11 is turned on and AC' is turned on to indicate it and AC' is set to a determined value.

SP16

AC' (16 bit) is converted into AC (8 bit) and the latter is saved.

SP17

Difference between dark portion potential $V_D$ and bright portion potential $V_L$, that is, contrast CNT is obtained. When CNT is less than 0 V or less than 396 V, both of LED15 and 14 are turned on. When CNT is in the range of from 396 V to 498 V, LED14 only is turned on. If CNT is highter than 498 V, then no LED is turned on.

Upon the completion of above operations, LED21 is turned off.

SP18

With the input of standard bright portion potential detection signal $\nu_L$CTP, LED22 is turned on, the standard potential $\nu_L$ is measured and its result is saved. It is checked whether $\nu_L$ is in the controlable range. When $\nu_L$ is less than −474 V or more than 288 V, the development bias voltage DB is set to a determined value and the latter is saved in area DBSA. When $\nu_L$ is within the controlable range, ($\nu_L$+102 V) is calculated and its result is saved in DBSA. Upon the completion of above operations, LED is turned off.

SP19

At the start of development, there is issued from CPU1 a development bias signal DBTP in response to which LED23 is turned on. Signal DBC of changeover switch SW1 is examined as to whether development bias control exists or not. When "no", the development bias is brought to 0 V. When "yes", the development bias voltage DB obtained at SP18 is issued out. Thereafer, the display subroutine is executed until the signal DBTP becomes "0". When it becomes "0", LED23 is turned off.

SP20

LED25 is turned off because it is to be put on when HVDC is "1". Since HVAC is "1" and HVDC is "0", now postrotation LSTR is going. No current is supplied to the primary charger and a weak current (60 μA) is supplied to AC discharger.

SP21

Mode is checked as to whether it is a potential measuring mode or not. In the case of "no", the potential sensor is turned off. The display subroutine is repeated until the post-rotation LSTR comes to end. If HVDC becomes "1" during the post-rotation, then the step is returned back to an SP3.

SP22

When HVAC is "0", it means that the apparatus is not under copying. Therefore, LED24 is turned off and outputs of the primary charger and AC discharger are cut off. Development bias voltage is returned to 0 V.

SP23

Mode is checked as to whether it is potential measuring mode or not. When "yes", the potential sensor is a driven and the measured value is displayed on LED10-17.

As described in detail in the above, the embodiment of the invention comprises means for forming an electrostatic latent image on a recording medium such as a photosensitive drum, means for developing said latent image, means for measuring the surface potential on said recording medium, first control means having a program stored therein for sequential control of said latent image forming means and second control means having a program stored therein for controlling conditions of latent image formation by said latent image forming means or conditions of development by said developing means by means of outputs from said measuring means. Said second control means is controlled by means of a timing signal coming from said first control means. This arrangement according to the invention enables one to develop programs for automatic control systems such as charger control, development bias control and the like independently of the development of sequence control program. Further, modification of program can be made very easily. The control program for sequence control is required to provide only a small number of timing signals. It is possible to make a program for sequence control separately from the automatic control system.

Further advantages of the invention are found in that diagnosis of trouble occurring in respective control means such as a microcomputer can be made easily and that various kinds of potential controls can be carried out as shown in the above embodiment. Function of the apparatus can be extended to a great extent.

Digital output values from the microcomputer CPU2 can be set to the respective standard values by using the changeover switch SW1 irrespective of outputs from A/D converter. Therefore, stable and high quality images can be assured even when trouble occurs in the electrometer, measuring circuit and A/D converter.

While the invention has been particularly shown and described with reference to preferred embodiments thereof, it will be understood by those skilled in the art that the foregoing and other changes in form and details can be made therein without departing from the scope of the invention.

What we claim is:

1. A recording apparatus comprising:
   - a plurality of processing means for forming an image on the recording medium;
   - a digital computer for providing controlling data to at least one of said processing means; and
   - signal generating means for generating a signal for blocking a controlling data output to one of said processing means at a time of initialization of said digital computer.

2. An electrostatic recording apparatus according to claim 1, wherein said signal generating means is a digital computer for sequence control which stores a program for sequence control of said electrostatic recording apparatus.

3. An electrostatic recording apparatus according to claim 2, wherein said initialization is carried out in accordance with a signal from said digital computer for sequence control.

4. An electrostatic recording apparatus comprising:

a plurality of processing means including means for charging a recording medium with electric charge for forming an image on the recording medium;

a digital computer for providing controlling data to said processing means; and blocking means for blocking said controlling data output to one of said processing means at a time of initialization of said digital computer;

wherein said charging means comprises a high voltage transformer for boosting an input voltage and said blocking means comprises a clamp circuit for clamping the input voltage to said high voltage transformer at a low voltage.

5. A recording apparatus comprising:

a plurality of processing means for forming an image on a recording medium, a first digital computer for providing controlling data to at least one of said processing means, a second digital computer having a program stored therein for sequence control of said electrostatic recording apparatus, and blocking means for blocking said controlling data output to one of said processing means at a time of initialization of said first digital computer, wherein said blocking means is actuated by an output signal from said second digital computer.

6. A recording apparatus comprising:

a plurality of processing means for forming an image on a recording medium, control means for providing a controlling output to said processing means in analog form, wherein said control means comprises a digital computer, and a digital-to-analog converter to convert a digital output of said digital computer to an analog value, wherein said controlling output to said processing means, associated with said digital-to-analog converter, is blocked at a time of initialization of said apparatus according to a specific signal different from the signal from said digital computer.

7. A recording apparatus according to claim 6, wherein said specific signal is a signal from said digital computer for sequence control.

8. A recording apparatus comprising:

a plurality of processing means for forming an image on a recording medium, detecting means for detecting an image forming condition in the apparatus, a first digital computer for controlling at least one of said processing means in accordance with the detection value of said detecting means to form a high quality image, and a second digital computer for controlling said first digital computer to control said processing means to provide a predetermined timing.

9. A recording apparatus comprising:

a plurality of processing means for forming an image on a recording medium;

a first digital computer for controlling at least one of said processing means; and a second digital computer for transferring data for image formation to said first digital computer wherein said first digital computer is initialized by a signal from said second digital computer.

10. A recording apparatus comprising:

a plurality of processing means for forming an image on a recording medium;

a first digital computer for controlling at least one of said processing means; and a second digital computer for transferring data for image formation to said first digital computer wherein said second digital computer blocks a controlling data output to one of said processing means at the time when the image formation is impossible.

11. A recording apparatus comprising:

a plurality of processing means for forming an image on a recording medium, said processing means includes an electric charger for charging a recording medium;

a first digital computer for controlling at least one of said processing means; and a second digital computer for transferring data for image formation to said first digital computer wherein said second digital computer blocks a controlling data output to said electrical charger at the time when the image formation is impossible.

* * * * *

UNITED STATES PATENT AND TRADEMARK OFFICE

CERTIFICATE OF CORRECTION

PATENT NO. : 4,420,247

DATED : December 13, 1983

INVENTOR(S) : KOJI SUZUKI, ET AL.

It is certified that error appears in the above-identified patent and that said Letters Patent is hereby corrected as shown below:

COLUMN 3

Line 31, delete "a" before "the".

COLUMN 4

Line 13, "19A-12" should read --19A-2--.

Line 19, "designages" should read --designates--.

Line 60, "the time" should read --that time--.

COLUMN 9

Line 67, "Trf105" should read --Tr105--.

COLUMN 12

Line 13, "decreases" should read --decrease--.

Line 45, before "drum" insert --the--.

COLUMN 15

Line 30, delete "and" before "stable".

COLUMN 19

Line 66, after "obtained" insert --a--.

COLUMN 20

Line 49, before "No." insert --the--.

Line 60, "gets" should read --becomes--.

Line 61, "trouble" should read --reason--.

UNITED STATES PATENT AND TRADEMARK OFFICE

CERTIFICATE OF CORRECTION

PATENT NO. : 4,420,247
DATED : December 13, 1983
INVENTOR(S) : KOJI SUZUKI, ET AL.

It is certified that error appears in the above-identified patent and that said Letters Patent is hereby corrected as shown below:

COLUMN 22

Line 49, delete "up" following "increases".

COLUMN 23

Line 67, delete "afraid".

COLUMN 24

Line 3, "such a" should read --such as--.

Line 10, delete "once".

Line 59, after "determined" insert --by--.

COLUMN 25

Line 9, "and40" should read --and 40--.

Line 10, "31 600V" should read -- -600V --.

Line 22, "FIGS.19's" should read --FIG. 19--.
"FIG. 19" should read --FIGS. 19A--.

Line 25, "does" should read --denotes--.

Line 26, "does" should read --denotes--.

COLUMN 26

Line 28, "LED21 puts on" should read --LED21 turns on--.

Line 44, before "in the case" insert --as--.

Line 50, "obtaind" should read --obtain--.

UNITED STATES PATENT AND TRADEMARK OFFICE

CERTIFICATE OF CORRECTION

PATENT NO. : 4,420,247

DATED : December 13, 1983

INVENTOR(S) : KOJI SUZUKI, ET AL.

It is certified that error appears in the above—identified patent and that said Letters Patent is hereby corrected as shown below:

COLUMN 27

Line 22, "hightер" should read --higher--.

Lines 31 and 35, "controlable" should read --controllable--.

Line 62, after "to" insert --an--.

Line 64, before "SP3" delete "an".

COLUMN 28

Line 5, before "potential" insert --a--.

Line 6, after "is" delete "a".

Lines 7 and 8, "LED1-0-17" should read --LED10-17--.

UNITED STATES PATENT AND TRADEMARK OFFICE

CERTIFICATE OF CORRECTION

PATENT NO. : 4,420,247

DATED : December 13, 1983

INVENTOR(S) : KOJI SUZUKI, ET AL.

It is certified that error appears in the above—identified patent and that said Letters Patent is hereby corrected as shown below:

CLAIM 4

Line 6, before "said" insert --at least one of--.

CLAIM 5

Line 7, delete "electrostatic".

Signed and Sealed this

*Twenty-second* Day of *May 1984*

[SEAL]

*Attest:*

GERALD J. MOSSINGHOFF

*Attesting Officer* *Commissioner of Patents and Trademarks*